US012404747B2

(12) United States Patent
Steele et al.

(10) Patent No.: US 12,404,747 B2
(45) Date of Patent: Sep. 2, 2025

(54) HIGH-PRESSURE MULTILATERAL JUNCTION WITH MAINBORE AND LATERAL ACCESS AND CONTROL

(71) Applicant: Halliburton Energy Services, Inc., Houston, TX (US)

(72) Inventors: David Joe Steele, Carrollton, TX (US); Srinivasa Prasanna Vemuri, Frisco, TX (US); Stacey Blaine Donovan, Fort Worth, TX (US); Morten Falnes, Sola (NO); Wesley Paul Dietz, Carrollton, TX (US); Christian Alexander Ramirez, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/118,317

(22) Filed: Dec. 10, 2020

(65) Prior Publication Data

US 2021/0172293 A1 Jun. 10, 2021

Related U.S. Application Data

(60) Provisional application No. 62/946,219, filed on Dec. 10, 2019.

(51) Int. Cl.
*E21B 41/00* (2006.01)
*E21B 17/18* (2006.01)
(Continued)

(52) U.S. Cl.
CPC ..... *E21B 41/0035* (2013.01); *E21B 17/18* (2013.01); *E21B 23/00* (2013.01);
(Continued)

(58) Field of Classification Search
CPC ... E21B 17/18; E21B 41/0035; E21B 41/0042
See application file for complete search history.

(56) References Cited

U.S. PATENT DOCUMENTS 3,542,404 A * 11/1970 Tribble ..... E21B 17/01 175/215
5,284,208 A 2/1994 Clemens et al.
(Continued)

FOREIGN PATENT DOCUMENTS

CN 105089565 11/2015
CN 106471209 3/2017
(Continued)

OTHER PUBLICATIONS

Dyer, S., et al., "New Intelligent Completion System Enables Compartment-Level Control in Multilateral Wells," Journal of Petroleum Technology, Aug. 15, 2016, vol. 68, Issue 9, 6 pages, https://pubs.spe.org/en/jpt/jpt-article-detail/?art=1385.

*Primary Examiner* — Tara Schimpf
*Assistant Examiner* — Lamia Quaim
(74) *Attorney, Agent, or Firm* — Scott Richardson; Parker Justiss, P.C.

(57) ABSTRACT

Provided is a y-block, a multilateral junction, and a method for forming a well system. The y-block, in one aspect, includes a housing having a first end and a second opposing end, and a single first bore extending into the housing from the first end, the single first bore defining a first centerline. The y-block according to this aspect further includes second and third separate bores extending into the housing and branching off from the single first bore, the second bore defining a second centerline and the third bore defining a third centerline, wherein the second and third centerlines are angled relative to one another.

36 Claims, 19 Drawing Sheets

(51) Int. Cl.

| | |
|---|---|
| ***E21B 23/00*** | (2006.01) |
| ***E21B 23/02*** | (2006.01) |
| ***E21B 43/14*** | (2006.01) |
| ***E21B 43/26*** | (2006.01) |
| *E21B 23/12* | (2006.01) |

(52) U.S. Cl.
CPC ..... *E21B 23/02* (2013.01); *E21B 41/0042* (2013.01); *E21B 43/26* (2013.01); *E21B 23/12* (2020.05); *E21B 43/14* (2013.01)

(56) References Cited

U.S. PATENT DOCUMENTS

| | | | | |
|---|---|---|---|---|
| 5,435,392 | A | 7/1995 | Kennedy | |
| 5,462,120 | A * | 10/1995 | Gondouin | E21B 7/061 166/380 |
| 5,979,560 | A | 11/1999 | Nobileau | |
| 6,047,774 | A | 4/2000 | Allen | |
| 6,056,059 | A | 5/2000 | Ohmer | |
| 6,089,320 | A | 7/2000 | LaGrange | |
| 6,276,457 | B1 | 8/2001 | Moffatt et al. | |
| 6,283,216 | B1 * | 9/2001 | Ohmer | E21B 43/105 166/117.6 |
| 6,354,375 | B1 | 3/2002 | Dewey | |
| 6,431,283 | B1 * | 8/2002 | Dale | E21B 41/0035 166/341 |
| 6,712,148 | B2 | 3/2004 | Fipke et al. | |
| 6,863,129 | B2 | 3/2005 | Ohmer et al. | |
| 6,907,930 | B2 | 6/2005 | Cavender et al. | |
| 6,915,847 | B2 | 7/2005 | Brockman | |
| 7,299,878 | B2 | 11/2007 | Steele | |
| 7,350,569 | B2 | 4/2008 | Collins et al. | |
| 7,779,924 | B2 | 8/2010 | Clamens | |
| 7,980,311 | B2 | 7/2011 | Dowling et al. | |
| 8,397,819 | B2 | 3/2013 | Tunget | |
| 8,695,694 | B1 | 4/2014 | Lajesic | |
| 8,701,775 | B2 | 4/2014 | Steele | |
| 8,967,277 | B2 | 3/2015 | Steele et al. | |
| 8,985,203 | B2 | 3/2015 | Stokes et al. | |
| 9,133,675 | B2 | 9/2015 | Telfer | |
| 9,133,697 | B2 | 9/2015 | Cavender et al. | |
| 9,140,082 | B2 | 9/2015 | Lajesic | |
| 9,140,102 | B2 | 9/2015 | Bartko et al. | |
| 9,194,213 | B2 | 11/2015 | Macleod et al. | |
| 9,243,465 | B2 | 1/2016 | Lajesic | |
| 9,260,945 | B2 | 2/2016 | Lajesic et al. | |
| 9,394,778 | B2 | 7/2016 | Anders | |
| 9,638,008 | B2 | 5/2017 | Stokes et al. | |
| 9,803,438 | B2 | 10/2017 | Stokes et al. | |
| 9,822,612 | B2 | 11/2017 | Steele et al. | |
| 9,874,062 | B2 | 1/2018 | Lajesic et al. | |
| 10,012,045 | B2 | 7/2018 | Lajesic | |
| 10,036,220 | B2 | 7/2018 | Lajesic et al. | |
| 10,060,225 | B2 | 8/2018 | Wolf et al. | |
| 10,167,684 | B2 | 1/2019 | Steele | |
| 10,196,880 | B2 | 2/2019 | Steele et al. | |
| 10,240,434 | B2 | 3/2019 | Steele et al. | |
| 10,352,140 | B2 | 7/2019 | Parlin et al. | |
| 10,435,993 | B2 | 10/2019 | Steele | |
| 10,465,452 | B2 | 11/2019 | Parlin | |
| 10,655,433 | B2 | 5/2020 | Hepburn et al. | |
| 10,731,417 | B2 | 8/2020 | Vemuri et al. | |
| 11,203,913 | B2 | 12/2021 | Martin et al. | |
| 11,371,305 | B2 | 6/2022 | Mickey et al. | |
| 2001/0025710 | A1 | 10/2001 | Ohmer et al. | |
| 2003/0029613 | A1 | 2/2003 | Danos et al. | |
| 2003/0062717 | A1 | 4/2003 | Thomas et al. | |
| 2005/0230121 | A1 * | 10/2005 | Martinez | E21B 43/123 166/372 |
| 2005/0241830 | A1 * | 11/2005 | Steele | E21B 41/0035 166/313 |
| 2007/0089875 | A1 | 4/2007 | Steele et al. | |
| 2007/0227727 | A1 | 10/2007 | Patel et al. | |
| 2010/0163240 | A1 | 7/2010 | Ingraham et al. | |
| 2010/0170677 | A1 | 7/2010 | Ingraham | |
| 2010/0276158 | A1 | 11/2010 | Ingraham | |
| 2012/0305268 | A1 * | 12/2012 | Steele | E21B 41/0035 166/50 |
| 2013/0081807 | A1 | 4/2013 | Dyer et al. | |
| 2013/0306324 | A1 * | 11/2013 | Tunget | E21B 43/14 166/313 |
| 2014/0345861 | A1 | 11/2014 | Stalder et al. | |
| 2015/0068756 | A1 | 3/2015 | Pendleton | |
| 2015/0233190 | A1 | 8/2015 | Wolf et al. | |
| 2015/0275587 | A1 | 10/2015 | Wolf et al. | |
| 2015/0376955 | A1 | 12/2015 | Wolf et al. | |
| 2016/0273312 | A1 | 9/2016 | Steele et al. | |
| 2016/0290079 | A1 | 10/2016 | Lajesic | |
| 2016/0348476 | A1 | 12/2016 | Stokes et al. | |
| 2017/0130537 | A1 | 5/2017 | Parlin | |
| 2017/0328177 | A1 | 11/2017 | Sheehan et al. | |

FOREIGN PATENT DOCUMENTS

| | | | | |
|---|---|---|---|---|
| CN | 105829639 | | 5/2019 | |
| EP | 2358974 | | 10/2016 | |
| EP | 2715041 | | 1/2019 | |
| EP | 3025005 | B1 | 3/2019 | |
| RU | 2436925 | C2 | 12/2011 | |
| RU | 2518701 | C2 | 6/2014 | |
| RU | 2588999 | C2 | 7/2016 | |
| RU | 2608375 | C2 | 1/2017 | |
| RU | 2655517 | C2 | 5/2018 | |
| RU | 2687729 | C1 | 5/2019 | |
| RU | 2719842 | C2 | 4/2020 | |
| WO | WO-0026501 | A1 * | 5/2000 | E21B 23/01 |
| WO | 2015030842 | A1 | 3/2015 | |
| WO | 2016010530 | A1 | 1/2016 | |
| WO | 2019027454 | A1 | 2/2019 | |

* cited by examiner

HIGH-PRESSURE MULTILATERAL JUNCTION WITH MAINBORE AND LATERAL ACCESS AND CONTROL

CROSS-REFERENCE TO RELATED APPLICATION

This application claims the benefit of U.S. Provisional Application Ser. No. 62/946,219, filed on Dec. 10, 2019, entitled "HIGH PRESSURE MIC WITH MAINBORE AND LATERAL ACCESS AND CONTROL", and incorporated herein by reference in its entirety.

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which.

DETAILED DESCRIPTION

Figure 1:
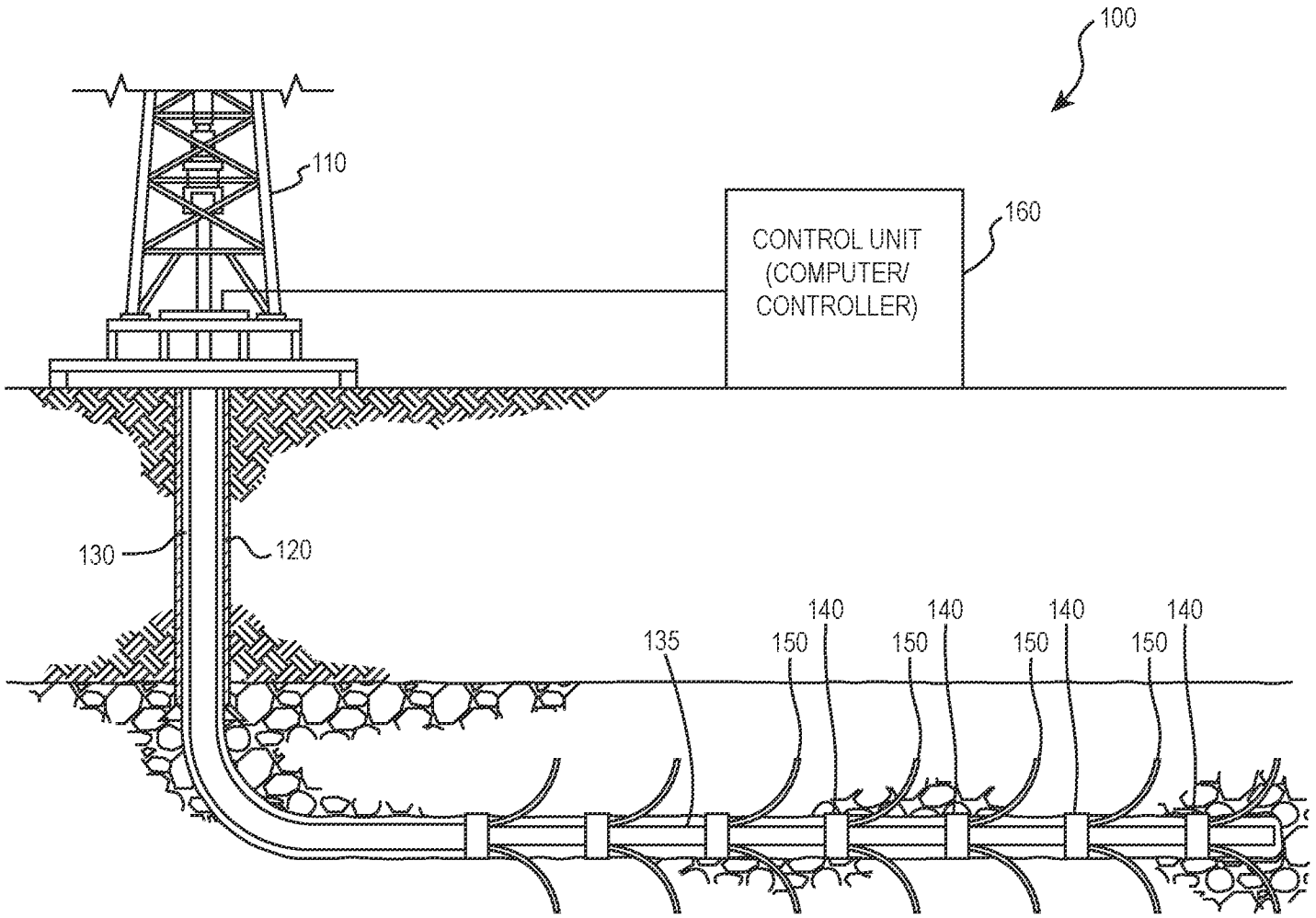
FIG. 1 illustrates a well system for hydrocarbon reservoir production, the well system including a y-block designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

A particular challenge for the oil and gas industry is developing a pressure tight TAML (Technology Advancement of Multilaterals) level 5 multilateral junction that can be installed in casing (e.g., 7⅝" casing) and that also allows for ID access (e.g., ~3½" ID access) to a main wellbore after the junction is installed. This type of multilateral junction could be useful for coiled tubing conveyed stimulation and/or clean-up operations. It is envisioned that future multilateral wells will be drilled from existing slots/wells where additional laterals are added to the existing wellbore. If a side track can be made from the casing (e.g., 9⅝" casing), there is an option to install a liner (e.g., 7" or 7⅝" liner) with a new casing exit point positioned at an optimal location to reach undrained reserves.

Referring now to FIG. 1, illustrated is a diagram of a well system 100 for hydrocarbon reservoir production, according to certain example embodiments. The well system 100 in one or more embodiments includes a pumping station 110, a main wellbore 120, tubing 130, 135, which may have differing tubular diameters, and a plurality of multilateral junctions 140, and lateral legs 150 with additional tubing integrated with a main bore of the tubing 130, 135. Each multilateral junction 140 may comprise a junction designed, manufactured or operated according to the disclosure, including a multilateral junction comprising a novel y-block according to the disclosure. The well system 100 may additionally include a control unit 160. The control unit 160, in this embodiment, is operable to control to and/or from the multilateral junctions and/or lateral legs 150, as well as other devices downhole.

Figure 2:
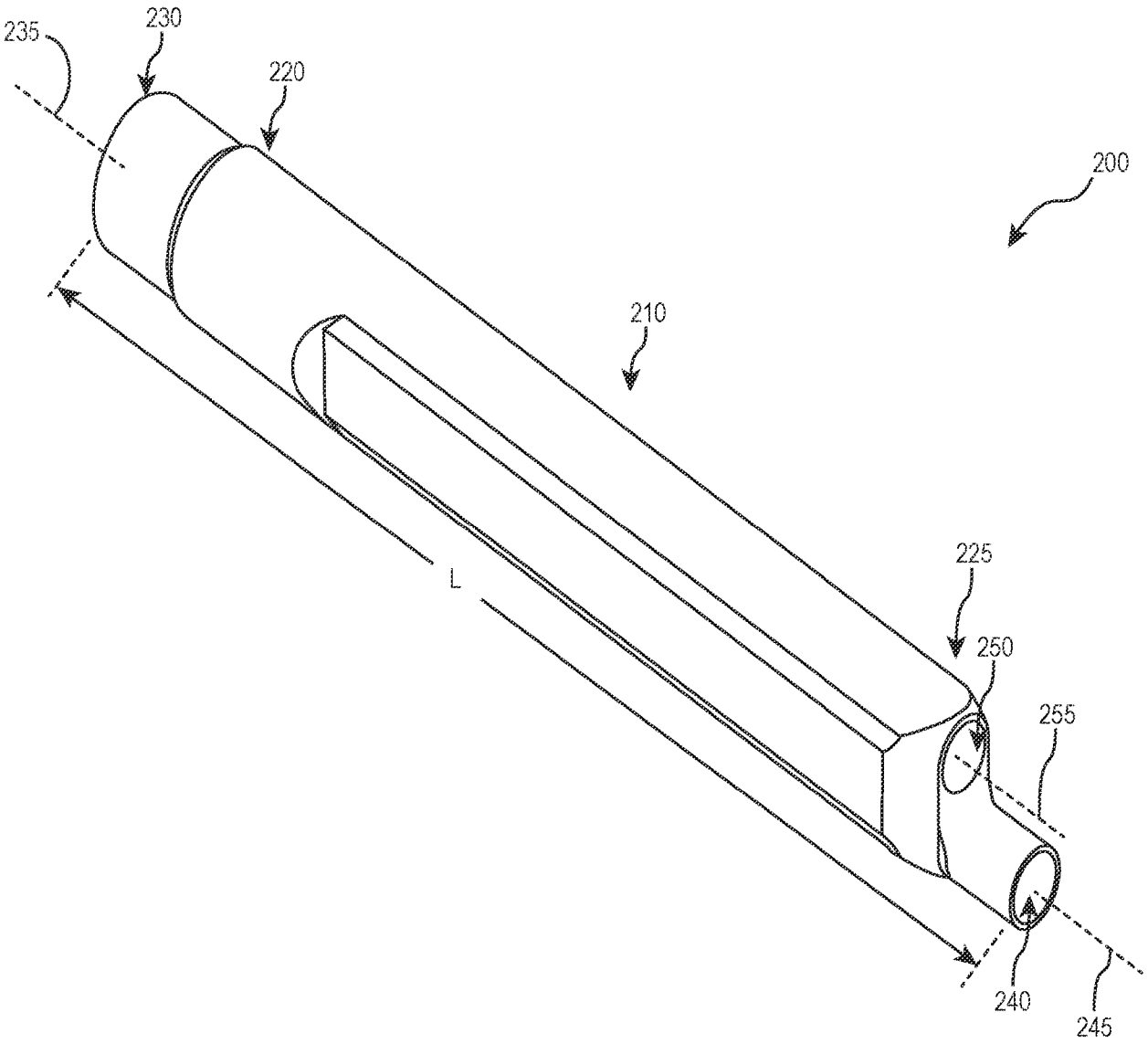
FIG. 2 illustrates a perspective view of a y-block designed, manufactured and operated according to one or more embodiments of the disclosure.

Turning to FIG. 2, illustrated is a perspective view of a y-block 200 designed, manufactured and operated according to one or more embodiments of the disclosure. The y-block 200 includes a housing 210. For example, the housing 210 could be a solid piece of metal having been milled to contain various different bores according to the disclosure. In another embodiment, the housing 210 is a cast metal housing formed with the various different bores according to the disclosure. The housing 210, in accordance with one embodiment, may include a first end 220 and a second opposing end 225. The first end 220, in one or more embodiments, is a first uphole end, and the second end 225, in one or more embodiments, is a second downhole end.

The housing 210 may have a length (L), which in the disclosed embodiment is defined by the first end 220 and the second opposing end 225. The length (L) may vary greatly and remain within the scope of the disclosure. In one embodiment, however, the length (L) ranges from about 0.5 meters to about 4 meters. In yet another embodiment, the length (L) ranges from about 1.5 meters to about 2.0 meters, and in yet another embodiment the length (L) is approximately 1.8 meters (e.g., approximately 72 inches).

The y-block 200, in one or more embodiments, includes a single first bore 230 extending into the housing 210 from the first end 220. In the disclosed embodiment, the single first bore 230 defines a first centerline 235. The y-block 200, in one or more embodiments, further includes a second bore 240 and a third bore 250 extending into the housing 210. In the illustrated embodiment the second bore 240 and the third bore 250 branch off from the single first bore 230 at a point between the first end 220 and the second opposing end 225. In accordance with one embodiment of the disclosure, the second bore 240 defines a second centerline 245 and the third bore 250 defines a third centerline 255. As will be discussed more fully below, the second centerline 245 and the third centerline 255 may be angled relative to one another in one or more embodiments consistent with the disclosure. Moreover, the y-block 200 provides equal and selective access to both legs.

Figure 3:
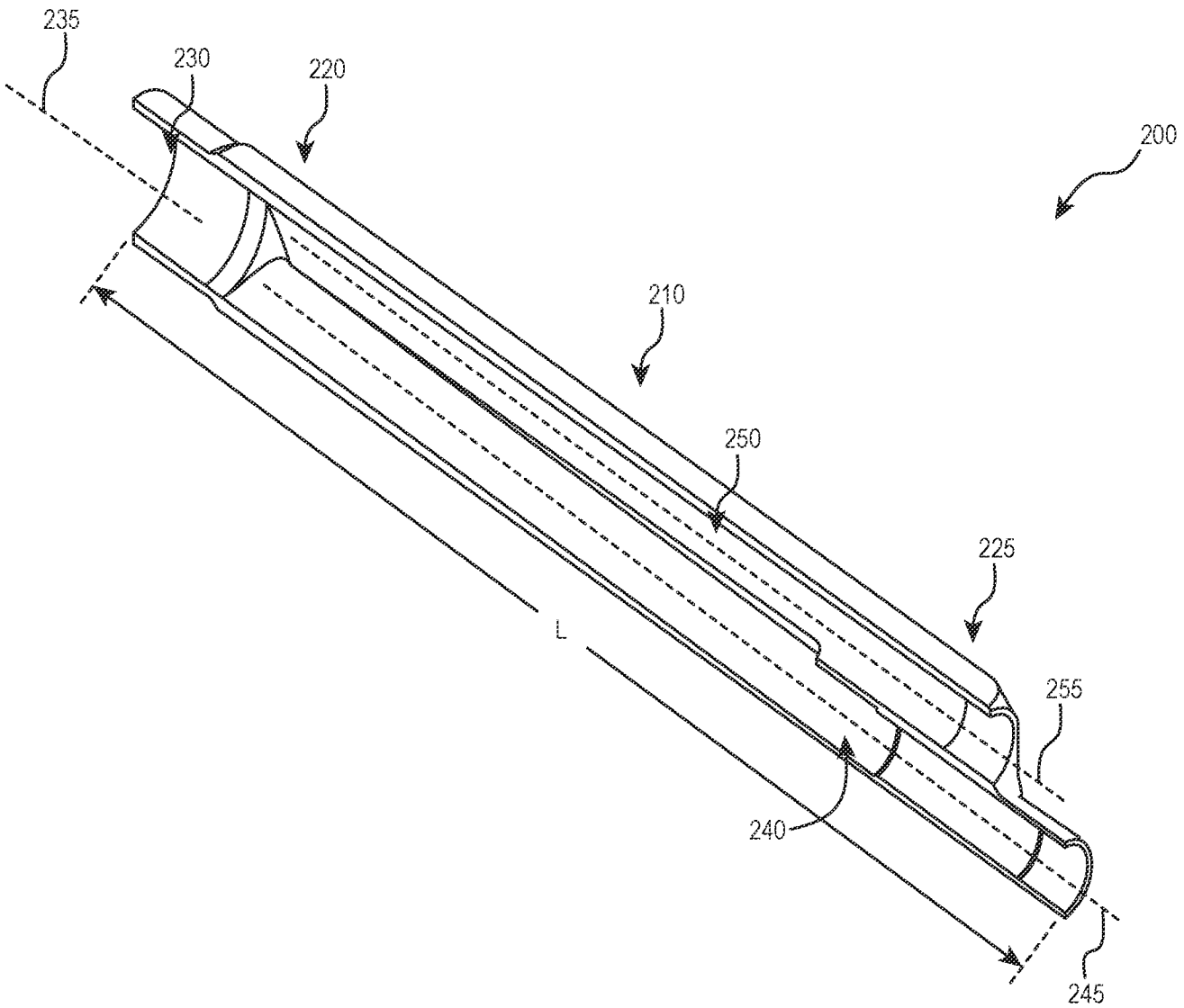
FIG. 3 illustrates a cross-section of the perspective view of the y-block illustrated in FIG. 2.

Turning to FIG. 3, illustrated is a cross-section of the perspective view of the y-block 200 illustrated in FIG. 2. FIG. 3 more clearly illustrates the first centerline 235, the second centerline 245 and the third centerline 255. FIG. 3 additionally illustrates how the second bore 240 and the third bore 250 branch off from the single first bore 230 at a point between the first end 220 and the second opposing end 225. Specific to the embodiment of FIG. 3, the second bore 240 and the third bore 250 branch off from the single first bore 230 at a point proximate the first end 220. In certain embodiments, such as that shown, the second and third bores 240, 250 overlap one another proximate the single first bore 230. Accordingly, the overlapped portion of the second and third bores 240, 250 may provide for commingling of fluids from the second bore 240 and the third bore 250 within the y-block 200. The second bore 240 and the third bore 250, in one or more embodiments, are a main leg bore and a lateral leg bore, respectively.

Figure 4:
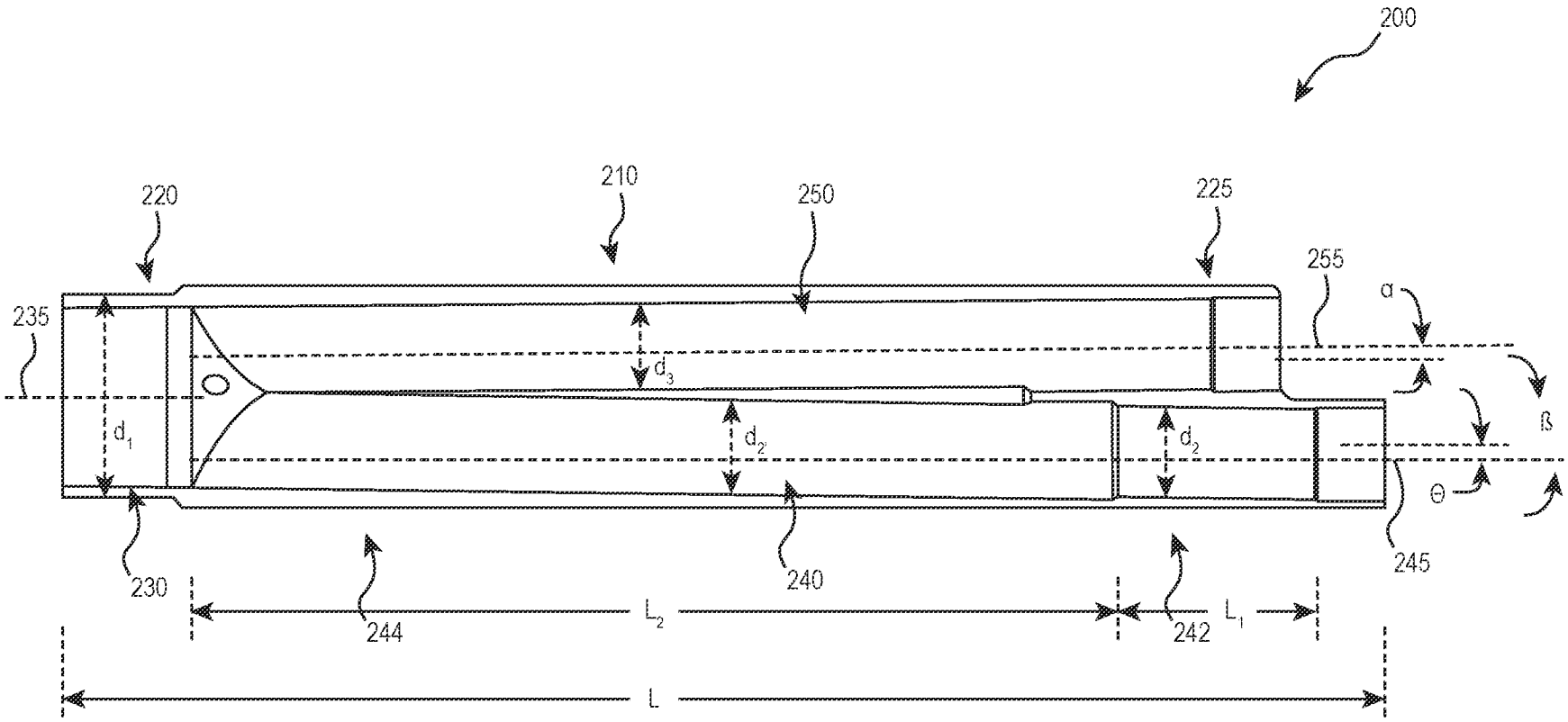
FIG. 4 illustrates a cross-section of a non-perspective view of the y-block illustrated in FIG. 2.

Turning to FIG. 4, illustrated is a cross-section of a non-perspective view of the y-block 200 illustrated in FIG. 2. FIG. 4 further illustrates that the second centerline 245 and the third centerline 255 are angled relative to one another, for example by an angle (β). This angle (β) helps with the frac burst rating of the y-block 200. In certain embodiments, the angle (β) helps the y-block 200 achieve a 5,000 psi burst rate, and in yet other embodiments the angle (β) helps the y-block 200 achieve a 8,000 psi burst rate, and in even yet other embodiments the angle (β) helps the y-block 200 achieve a 10,000 psi burst rate. The angle (β) may vary greatly based upon the length (L), but tends to be below about 3 degrees. In certain other embodiments, the angle (β) may be less than 2 degrees, and in certain embodiments approximately 1 degree or less.

Further to the embodiment of FIG. 4, the second centerline 245 is angled relative to the first centerline 235, and in yet another embodiment the third centerline 255 is angled relative to the first centerline 235. Accordingly, one or both of the second centerline 245 and/or third centerline 255 may be angled relative to the first centerline 235. For example, the second centerline 245 might have an angle (θ) between itself and the first centerline 235, and the third centerline 255 might have an angle (α) between itself and the first centerline 235. In one or more embodiments of the disclosure, the angle (θ) is greater than the angle (α). The angle (θ) may vary greatly based upon the length (L), but tends to be below about 1 degree. In certain other embodiments, the angle (θ) may be less than 0.75 degrees, and in certain embodiments approximately 0.6 degrees. The angle (α) may also vary greatly based upon the length (L), but tends to be below about 1 degree. In certain other embodiments, the angle (α) may be less than 0.75 degrees, and in certain embodiments approximately 0.4 degrees. Assuming that the first centerline 235 is a horizontal line, and the second centerline 245 angles down from horizontal by the angle (θ) and the third centerline 255 angles up from the horizontal line by the angle (α), the angle (θ) and the angle (α) would add up to the angle (β) discussed above.

The second and third centerlines 245, 255, in one or more embodiments, are straight centerlines extending along the length (L) of the y-block 200. For example, in this embodiment, the second bore 240 and/or third bore 250 would each include only a single straight centerline, as opposed to each including two or more angularly offset centerlines. Moreover, even if the second bore 240 and/or third bore 250 have different portions with different diameters, such as is the case with the second bore 240 illustrated in FIG. 4, in accordance with this embodiment the second centerline 245 and third centerline 255 would still each include only a single straight centerline. Moreover, it should be noted that centerline 235 does not need to be concentric with the OD defined by 244.

The single first bore 230, the second bore 240 and the third bore 250 may have different diameters and remain with the scope of the disclosure. In one embodiment, the single first bore 230 has a diameter ($d_1$). The diameter ($d_1$) may range greatly, but in one or more embodiments the diameter ($d_1$) ranges from about 2.5 cm to about 60.1 cm (e.g., from about 1 inches to about 24 inches). The diameter ($d_1$), in one or more embodiments, ranges from about 7.6 cm to about 40.6 cm (e.g., from about 3 inches to about 16 inches). In yet another embodiment, the diameter ($d_1$) may range from about 15.2 cm to about 30.5 cm (e.g., from about 6 inches to about 12 inches). In yet another embodiment, the diameter ($d_1$) may range from about 17.8 cm to about 25.4 cm (e.g., from about 7 inches to about 10 inches), and more specifically in one embodiment a value of about 21.6 cm (e.g., about 8.5 inches).

In one embodiment, the third bore 250 has a diameter ($d_3$). The diameter ($d_3$) may range greatly, but in one or more embodiments the diameter ($d_3$) ranges from about 0.64 cm to about 50.8 cm (e.g., from about ¼ inches to about 20 inches). The diameter ($d_3$), in one or more other embodiments, ranges from about 2.5 cm to about 17.8 cm (e.g., from about 1 inches to about 7 inches). In yet another embodiment, the diameter ($d_3$) may range from about 6.4 cm to about 12.7 cm (e.g., from about 2.5 inches to about 5 inches). In yet another embodiment, the diameter ($d_3$) may range from about 7.6 cm to about 10.2 cm (e.g., from about 3 inches to about 4 inches), and more specifically in one embodiment a value of about 8.9 cm (e.g., about 3.5 inches).

In one embodiment, the second bore 240 has a diameter ($d_2$). The diameter ($d_2$) may range greatly, but in one or more embodiments the diameter ($d_2$) ranges from about 0.64 cm to about 50.8 cm (e.g., from about ¼ inches to about 20 inches). The diameter ($d_2$), in one or more embodiments, ranges from about 2.5 cm to about 17.8 cm (e.g., from about 1 inches to about 7 inches). In yet another embodiment, the diameter ($d_2$) may range from about 6.4 cm to about 12.7 cm (e.g., from about 2.5 inches to about 5 inches). In yet another embodiment, the diameter ($d_2$) may range from about 7.6 cm to about 10.2 cm (e.g., from about 3 inches to about 4 inches), and more specifically in one embodiment a value of about 8.9 cm (e.g., about 3.5 inches). In certain other embodiments, the second bore 240 has a first portion 242 and a second portion 244. In the illustrated embodiment, the first portion 242 has the diameter ($d_2$) and the second portion has a greater diameter ($d_{2'}$). The greater diameter ($d_{2'}$) provides the ability to land all the necessary tools within the y-block 200. The greater diameter ($d_{2'}$) may range greatly, but in one or more embodiments the greater diameter ($d_{2'}$) ranges from about 0.95 cm to about 53.3 cm (e.g., from about ⅜ inches to about 21 inches). The greater diameter ($d_{2'}$), in one or more embodiments, ranges from about 3.18 cm to about 18.4 cm (e.g., from about 1.25 inches to about 7.25 inches). In yet another embodiment, the greater diameter ($d_{2'}$) may range from about 7 cm to about 13.34 cm (e.g., from about 2.75 inches to about 5.25 inches). In yet another embodiment, the diameter ($d_2$) may range from about 8.26 cm to about 10.8 cm (e.g., from about 3.25 inches to about 4.25 inches), and more specifically in one embodiment a value of about 9.53 cm (e.g., about 3.75 inches). In certain other embodiments, the second diameter ($d_2$) is equal to the third diameter ($d_3$), and the greater diameter ($d_{2'}$) is larger than both the second diameter ($d_2$) and the third diameter ($d_3$).

In certain embodiments, the second portion 244 is located between the first portion 242 and the single first bore 230. Furthermore, in certain other embodiments, the first portion 242 has a length ($L_1$) and the second portion 244 has a length ($L_2$). In accordance with one or more embodiments, the length ($L_2$) of the second portion 244 is at least two times a length ($L_1$) of the first portion 242. In accordance with one or more other embodiments, the length ($L_2$) of the second portion 244 is at least three times a length ($L_1$) of the first portion 242.

The single first bore 230, second bore 240 and third bore 250, in one or more embodiments, are configured to connect with various different features. For example, in one or more embodiments, the single first bore 230 may include a box joint or a pin joint for engaging with the other uphole features. Similarly, the second bore 240 could include a box joint or a pin joint for engaging with the other downhole features, such as main wellbore leg. In one or more other embodiments, the third bore 250 might be relegated to a box joint for engaging with other downhole features, such as the lateral wellbore leg. Nevertheless, the present disclosure should not limit the type of joint any of the single first bore 230, second bore 240 or third bore 250 could employ.

Figure 5A:
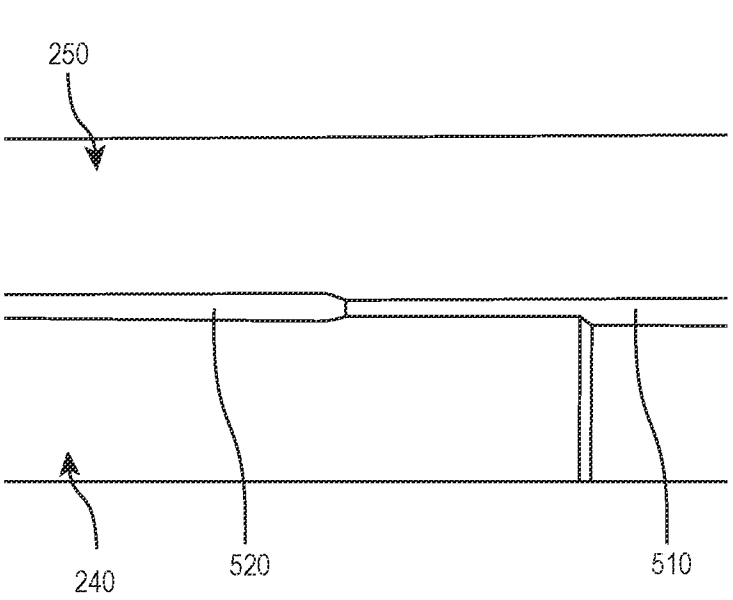
FIGS. 5A and 5B illustrate various different cross-sectional views of an area of the y-block where the second and third bores overlap one another.
Figure 5B:
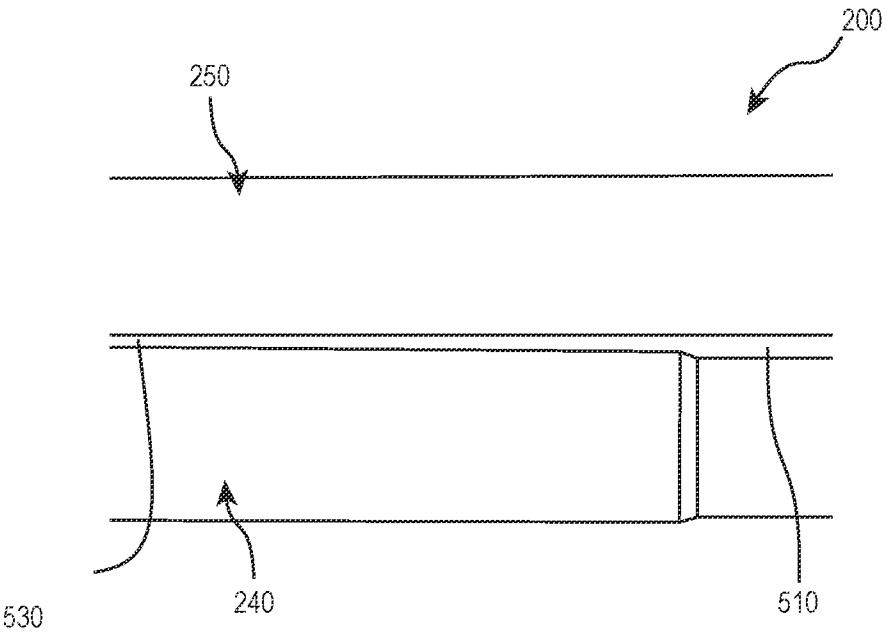

Turning to FIGS. 5A and 5B, illustrated are various different cross-sectional views of an area of the y-block 200 where the second and third bores 240, 250 overlap one another. As shown in FIG. 5A, which is similar to the y-block of FIG. 4, a shared interior wall 510 of the second and third bores 240, 250 comes to a blunt stress relief point 520 at a location wherein the second and third bores 240, 250 come together. Essentially, the blunt stress relief point 520 removes the extremely thin sidewall areas of the second and third bores 240, 250 as they approach one another, for example to prevent them from physically collapsing under pressure and potentially damaging the y-block 200. This blunt stress relief point 520, may be formed by one or more different machining processes. In certain embodiments, a milling process is used to form the blunt stress relief point 520. In other embodiments, an electric discharge machining (EDM) process is used to form the blunt stress relief point 520. In contrast, FIG. 5B illustrates the shared interior wall of the second and third bores 240, 250 coming to a sharp point 530 at a location wherein the second and third bores 240, 250 come together. The sharp point 530 remains susceptible to collapsing, but in certain embodiments the collapsed area adds certain benefits.

Figure 6:
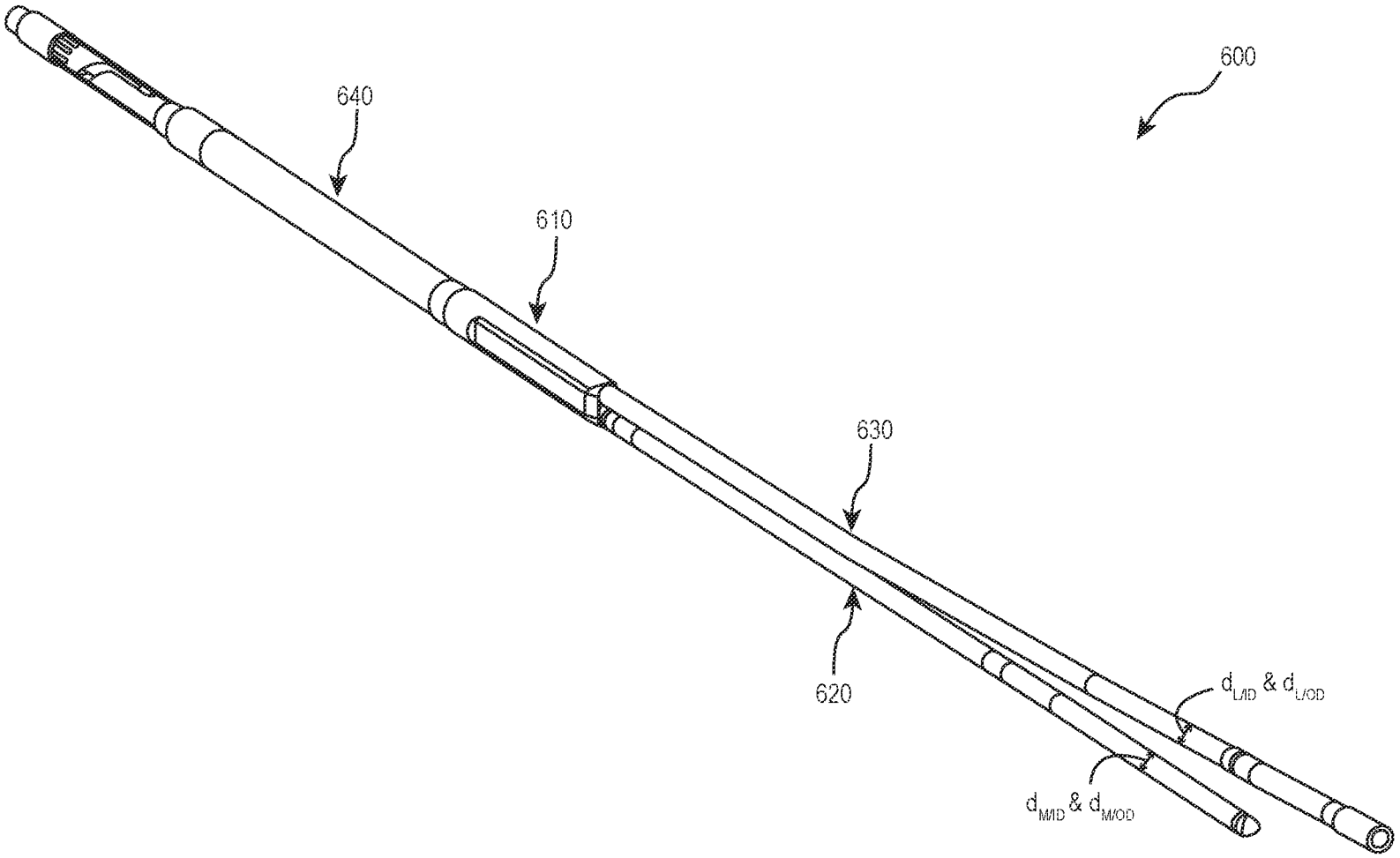
FIG. 6 illustrates one embodiment of a multilateral junction designed, manufactured and operated according to the disclosure.

Turning to FIG. 6, illustrated is one embodiment of a multilateral junction 600 designed, manufactured and operated according to the disclosure. The multilateral junction 600, in the illustrated embodiment, includes a y-block 610, a main bore leg 620, and a lateral bore leg 630. The y-block 610 may comprise any y-block consistent with the disclosure, including the y-block 200 discussed above with regard to FIGS. 2 through 5B.

The main bore leg 620 and the lateral bore leg 630, in the illustrated embodiment, are threadingly engaged with the y-block 610. In at least one or more embodiments, the main bore leg 620 includes an outer diameter ($d_{M/OD}$) and an inner diameter ($d_{M/ID}$). Similarly, the lateral bore leg 630 includes an outer diameter ($d_{L/OD}$) and an inner diameter ($d_{L/ID}$).

The multilateral junction 600 may additionally include a tubular 640. The tubular 640, in at least one embodiment, is configured to provide a consistent (e.g., laminar) flow through the multilateral junction 600 to reduce turbulence, and include a spacer insert. The tubular 640 may also, in certain embodiments, guide an intervention tool (e.g., frac tool) into the second bore (e.g., main bore) side of the y-block 610.

In accordance with one embodiment, a deflector (not shown) may be installed in or above the y-block 610. The deflector, in this example, may be permanently installed, run-in-hole on a separate trip as the multilateral junction 600, or run-in-hole on the same trip as the multilateral junction 600. In other embodiments, the y-block 610 is a single solid housing having the single first bore, the second bore and the third bore formed therein, and to the extent a deflector is necessary, it is formed as an integral portion of the housing. This is opposed to a situation where a separate deflector assembly is positioned within the housing of the y-block 610.

The multilateral junction 600 may additionally include a TEW ("tubing exit whipstock) sleeve. The TEW sleeve, not shown, is located within the tubular 640 and in certain embodiments proximate to or within the y-block 610. The TEW sleeve, when used, is operable to deflect intervention tools (e.g., such as a fracturing string), into the third bore (e.g., lateral bore) of the multilateral junction 600. The TEW sleeve may be installed and retrieved using a hydraulic running/retrieving tool, among other tools. In certain embodiments, the TEW sleeve is held in the multilateral junction 600 using a collet.

The multilateral junction 600, in one or more embodiments, is a high pressure multilateral junction. For example, in at least one embodiment, the multilateral junction 600 is capable of withstanding at least 8,000 psi burst rate. In yet another example, the multilateral junction 600 is capable of withstanding at least 10,000 psi burst rate. In at least one embodiment, the multilateral junction 600 is capable of withstanding at least 5000 psi collapse rate. In yet another example, the multilateral junction 600 is capable of withstanding at least 7000 psi collapse rate. Accordingly, the multilateral junction 600 may be employed to access and fracture one or both of the main wellbore and/or lateral wellbore. For example, the multilateral junction 600 could have the necessary pressure ratings, outside diameters, and inside diameters necessary to run a fracturing string there through, and thereafter appropriately and safely fracture one or both of the main wellbore and/or lateral wellbore.

Thus, in accordance with one or more embodiments of the disclosure, the multilateral junction 600 is capable of withstanding at least 10,000 psi burst rate, with the main bore leg 620 and lateral bore leg 630 having an inner diameter ($d_{M/ID}$) and diameter ($d_{L/ID}$), respectively, of at least about 80 mm (e.g., about 3.15 inches). In certain other embodiments, the main bore leg 620 and lateral bore leg 630 have an inner diameter ($d_{M/ID}$) and diameter ($d_{L/ID}$), respectively, of at least about 87 mm (e.g., about 3.423 inches). In certain other embodiments, the main bore leg 620 and lateral bore leg 630 have an inner diameter ($d_{M/ID}$) and diameter ($d_{L/ID}$), respectively, of at least about 90 mm (e.g., about 3.548 inches). In certain embodiments, the main bore leg 620 and lateral bore leg 630 have an outer diameter ($d_{M/OD}$) and diameter ($d_{L/OD}$), respectively, of at least about 101.6 mm (e.g., about 4.0 inches). Accordingly, a fracturing string having an outside diameter ($d_{F/OD}$) of at least about 78 mm (e.g., about 3.07 inches) could travel through the multilateral junction 600 and engage with a main wellbore completion or lateral wellbore completion, for fracturing the main wellbore or lateral wellbore, respectively. In yet another embodiment, a fracturing string having an outside diameter ($d_{F/OD}$) of at least about 85.7 mm (e.g., about 3.375 inches) could travel through the multilateral junction 600 and engage with a main wellbore completion or lateral wellbore completion, for fracturing the main wellbore or lateral wellbore, respectively. Such fracturing strings may additionally have an inside diameter ($d_{f/ID}$) of at least about 50.8 mm (e.g., about 2 inches). In accordance with this embodiment, the diameter ($d_2$) of the second bore of the y-block 610 and the diameter ($d_3$) of the third bore of the y-block 610, might have an inside diameter, of about 87 mm (e.g., about 3.423 inches). Heretofore, nobody was capable of fracturing through the main bore leg 620 and/or lateral bore leg 630 at the aforementioned high pressures.

Figure 7:
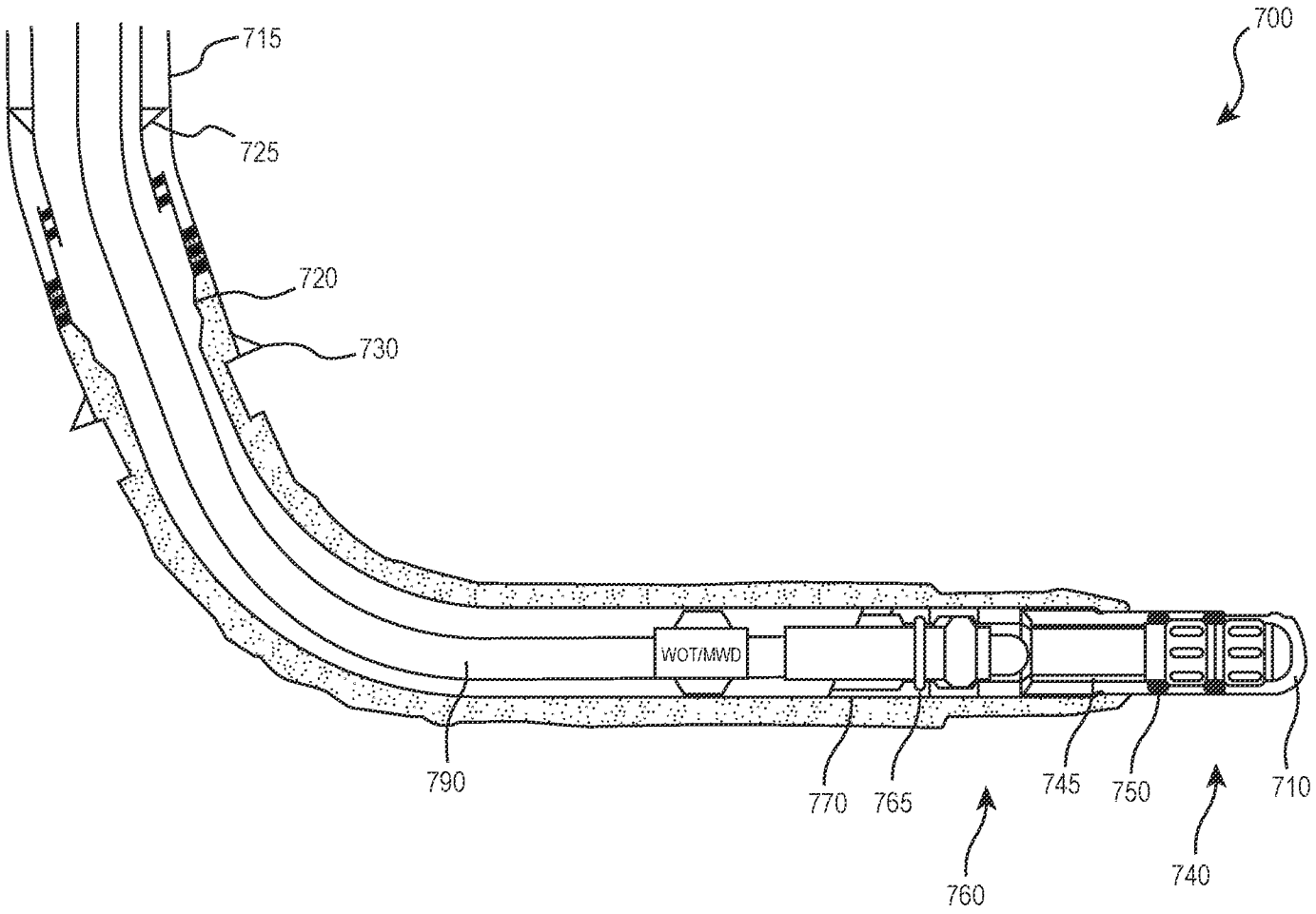
FIGS. 7 through 19 illustrate a method for forming, fracturing and/or producing from a well system.

Turning now to FIGS. 7 through 18, illustrated is a method for forming, accessing, potentially fracturing, and producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and measurement while drilling (MWD) tool may be coupled to the running tool 790, and thus be used to orient the anchor system 760.

Figure 8:
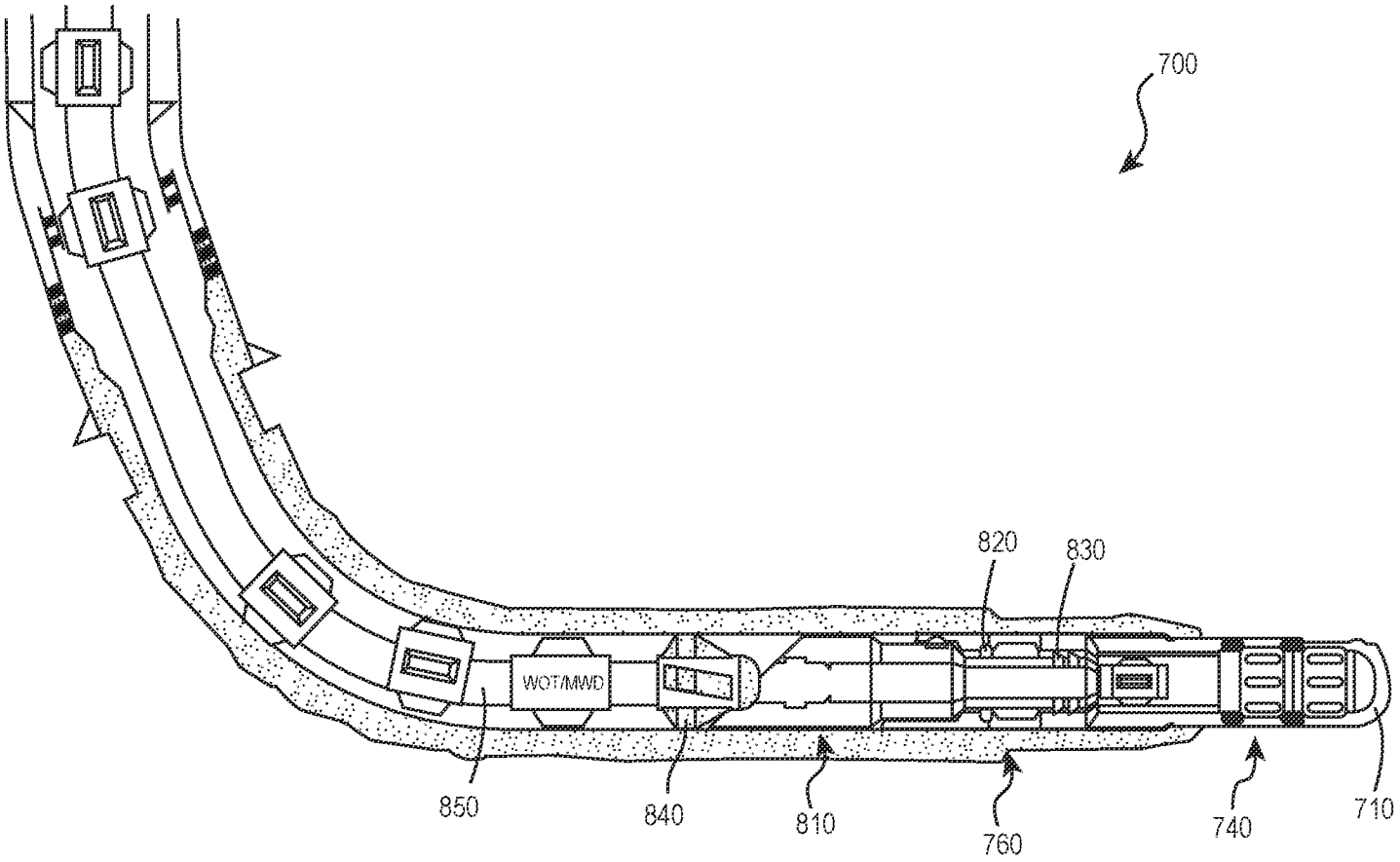

Turning to FIG. 8, illustrated is the well system 700 of FIG. 7 after positioning a whipstock assembly 810 downhole at a location where a lateral wellbore is to be formed. The whipstock assembly 810 includes a collet 820 for engaging the collet profile 765 in the anchor system 760. The whipstock assembly 810 additionally includes one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. The WOT/MWD tool may be employed to orient the whipstock assembly 810.

Figure 9:
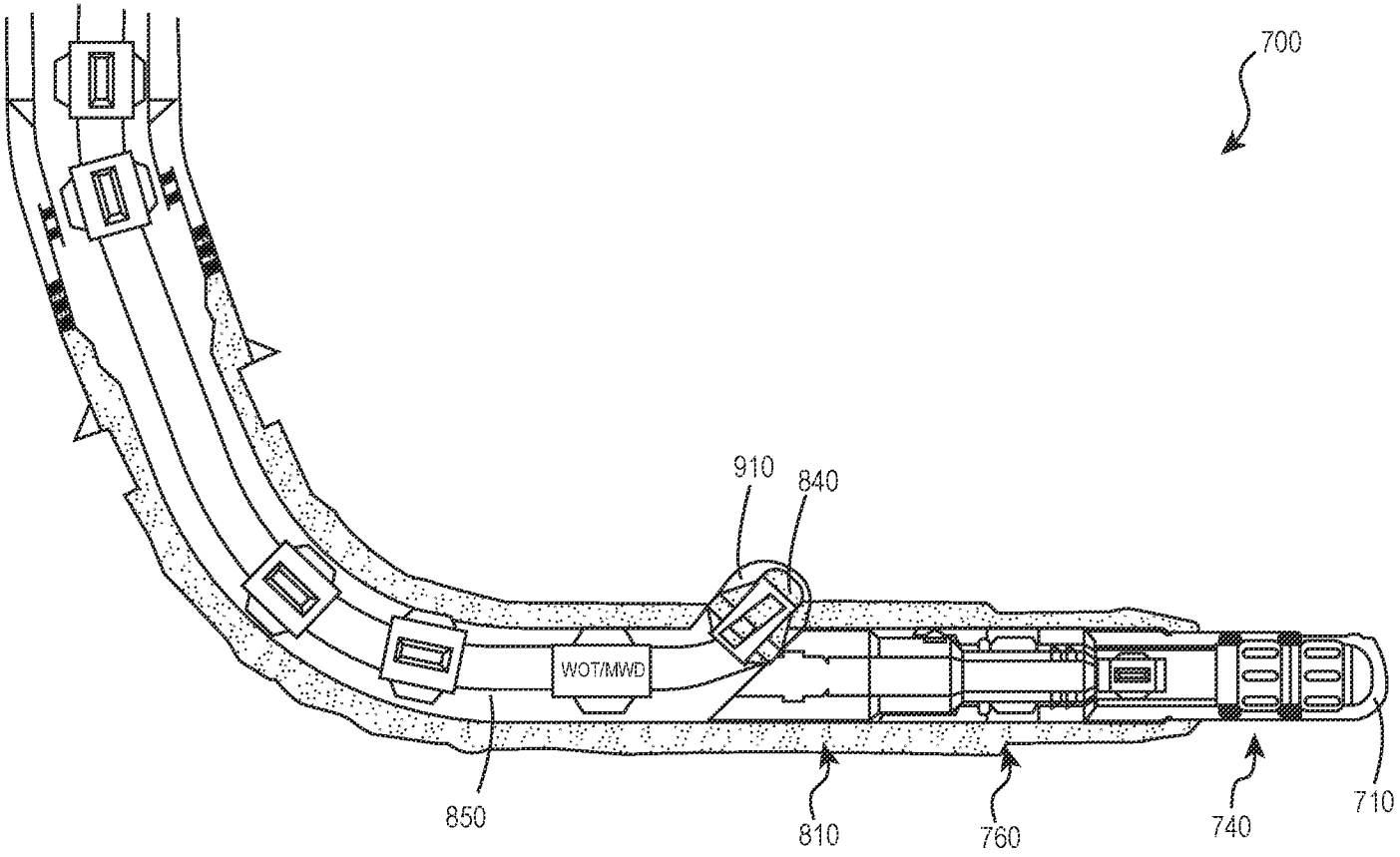

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 7.0 m long, and in certain other embodiments about 2.5 m long, and extends through the casing 720. Thereafter, a circulate and clean process could occur, and then the drill string 850 and lead mill 840 may be pulled out of hole.

Figure 10:
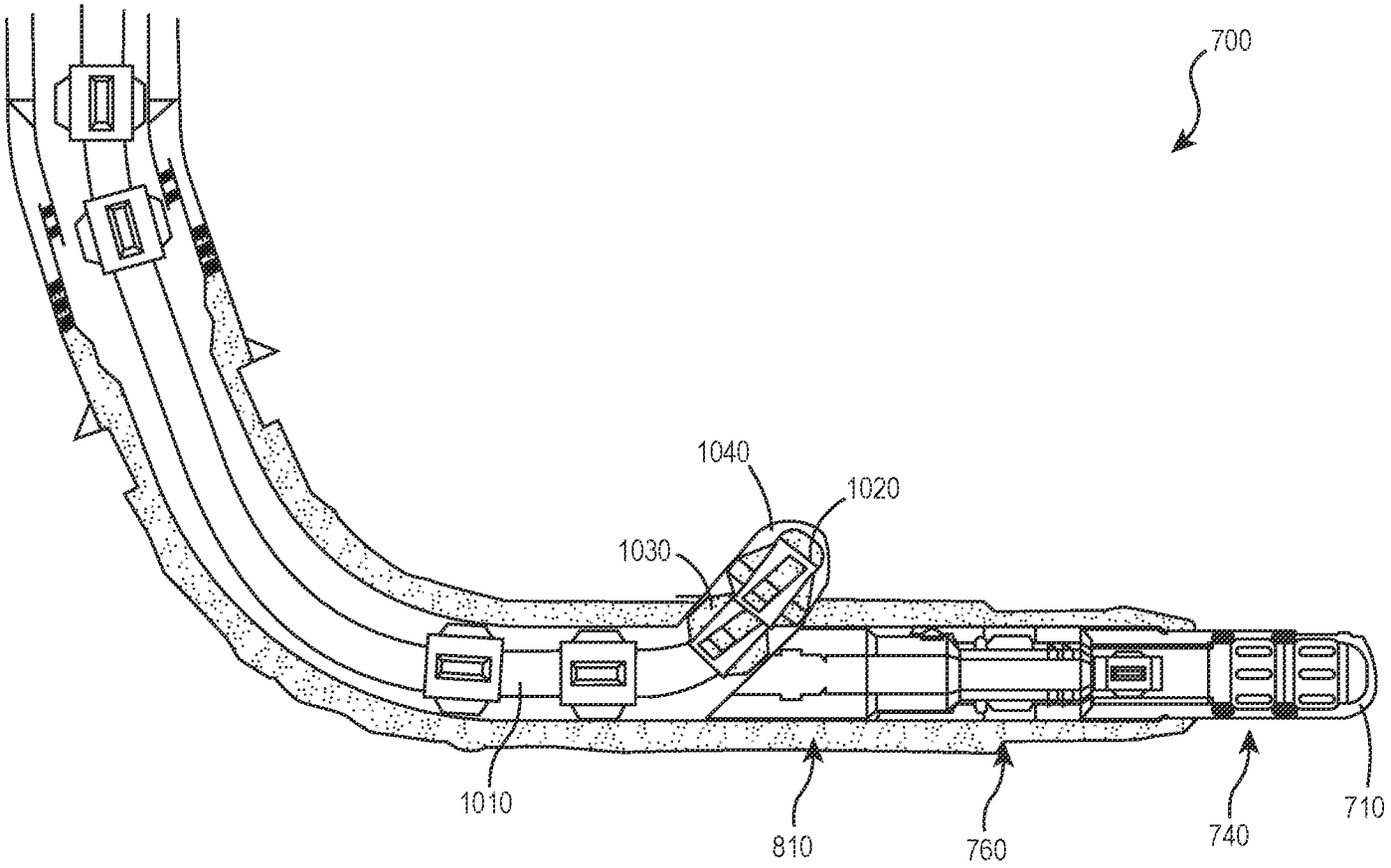

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 5 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
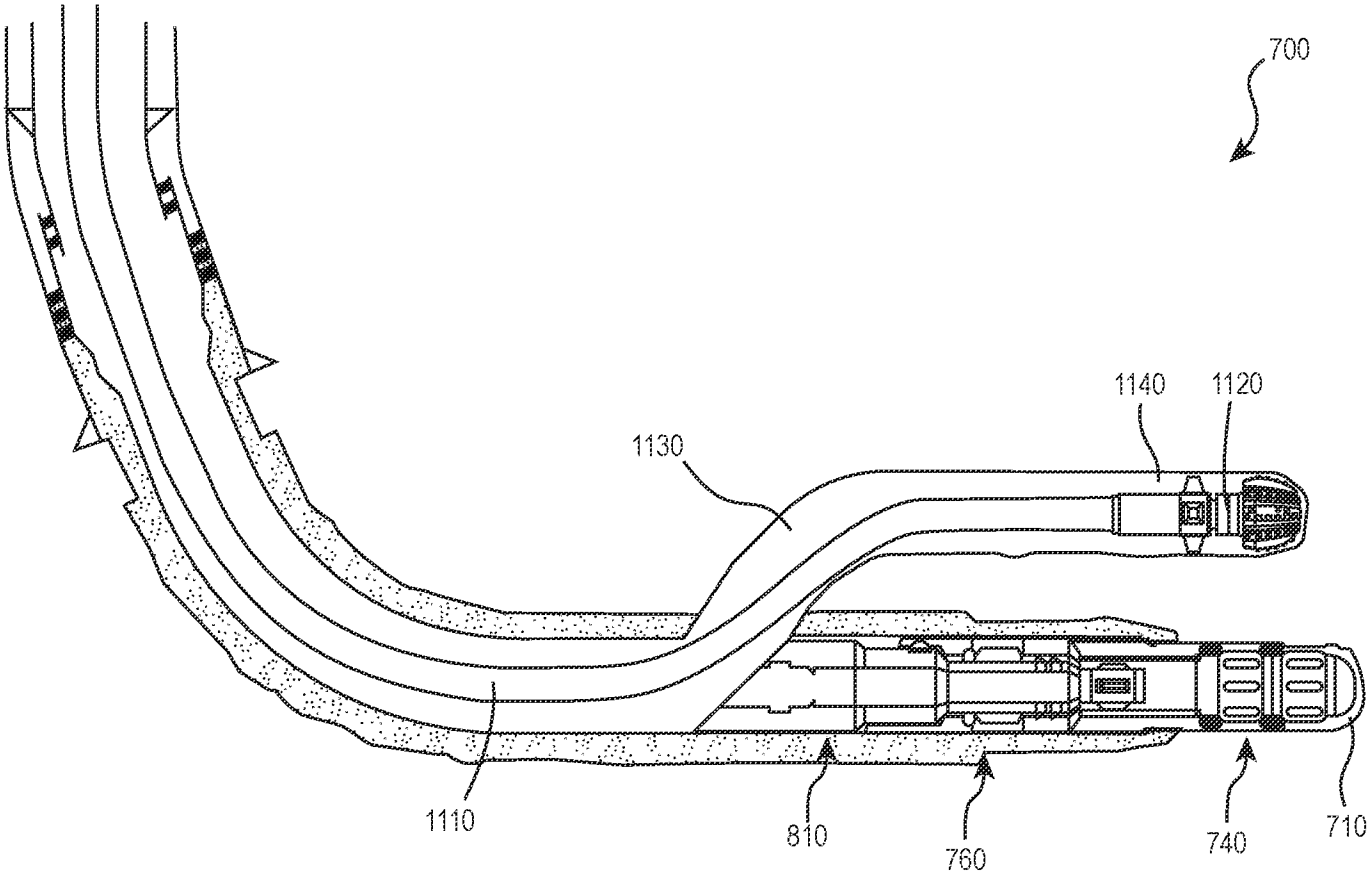

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
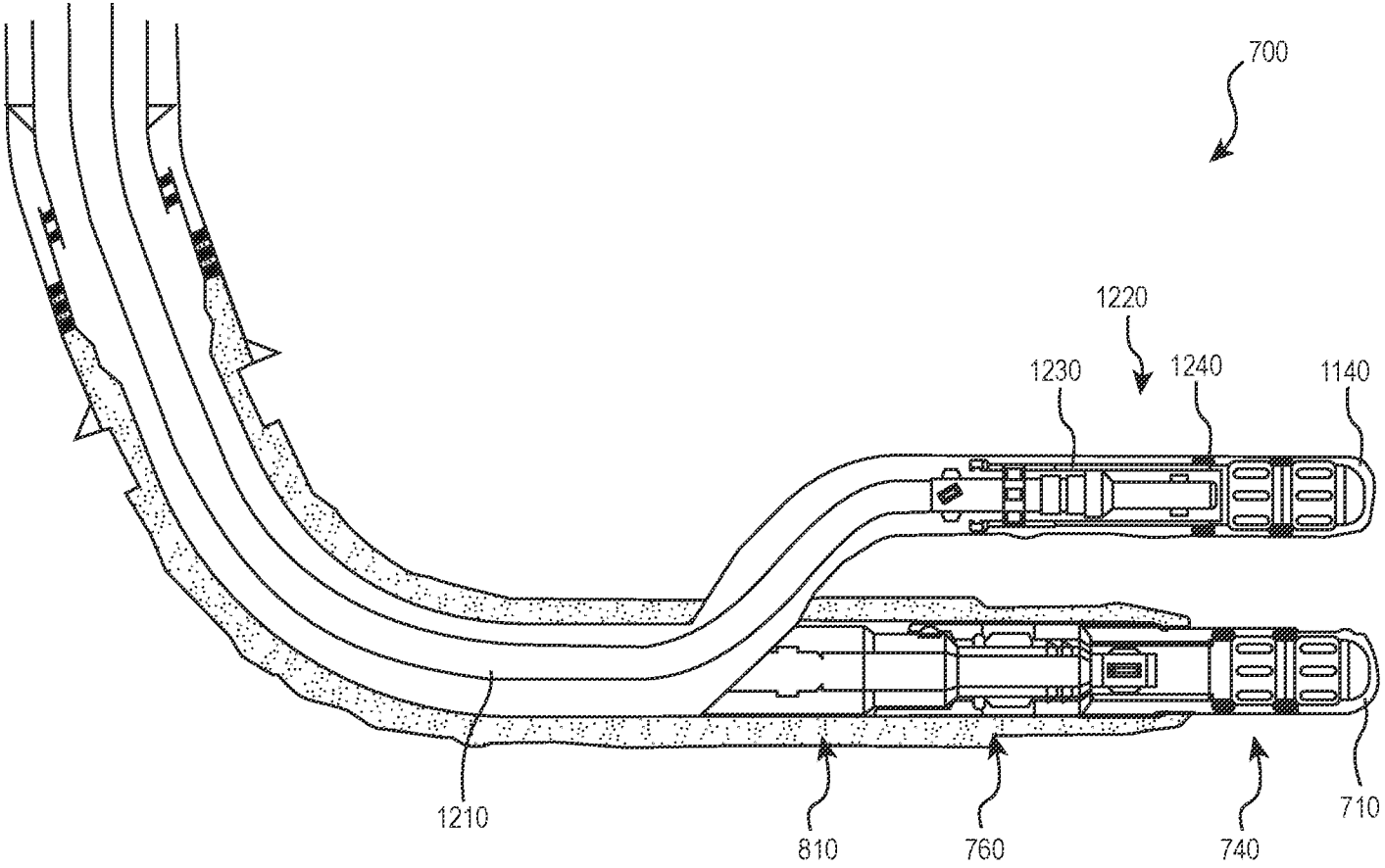

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
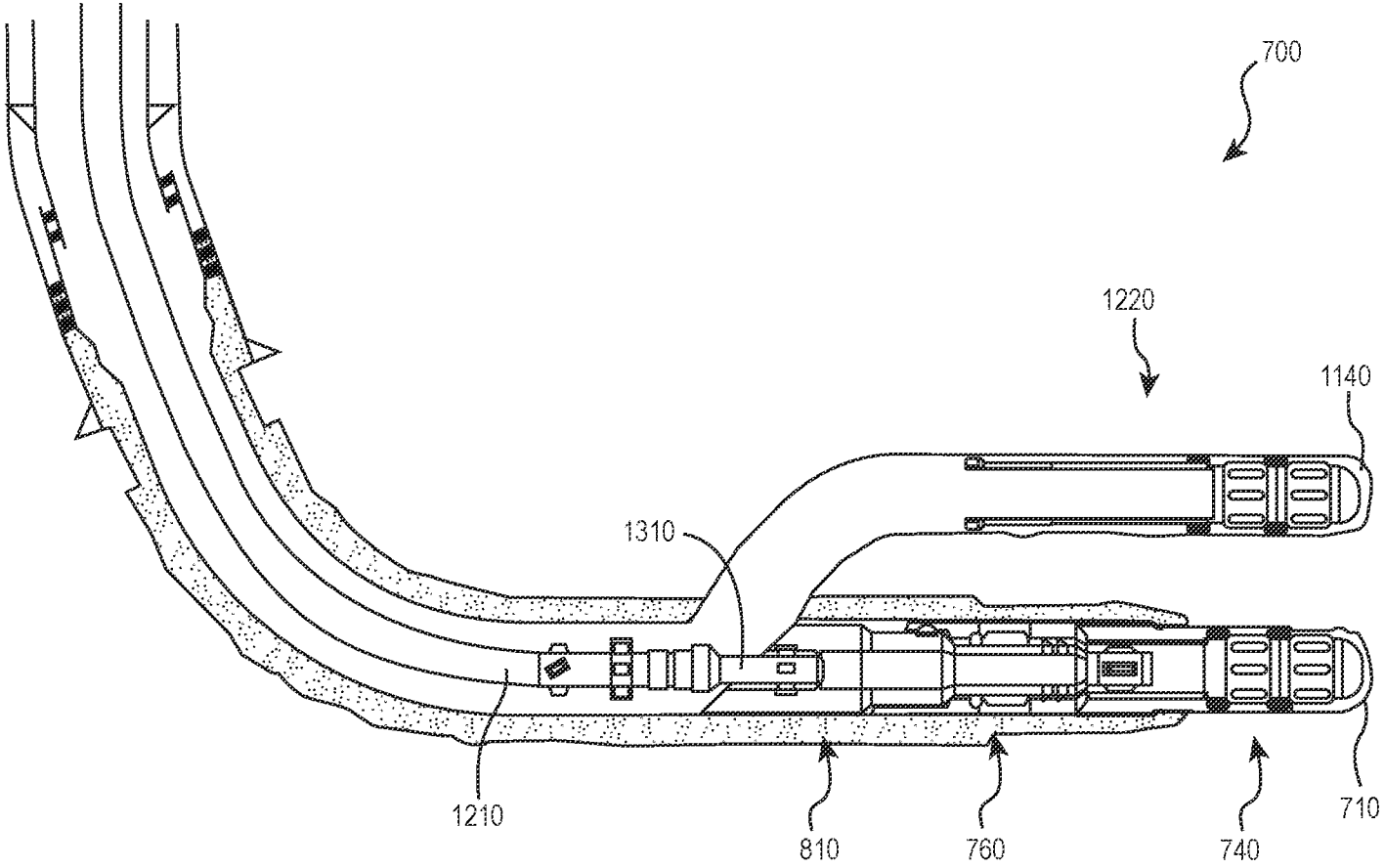

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
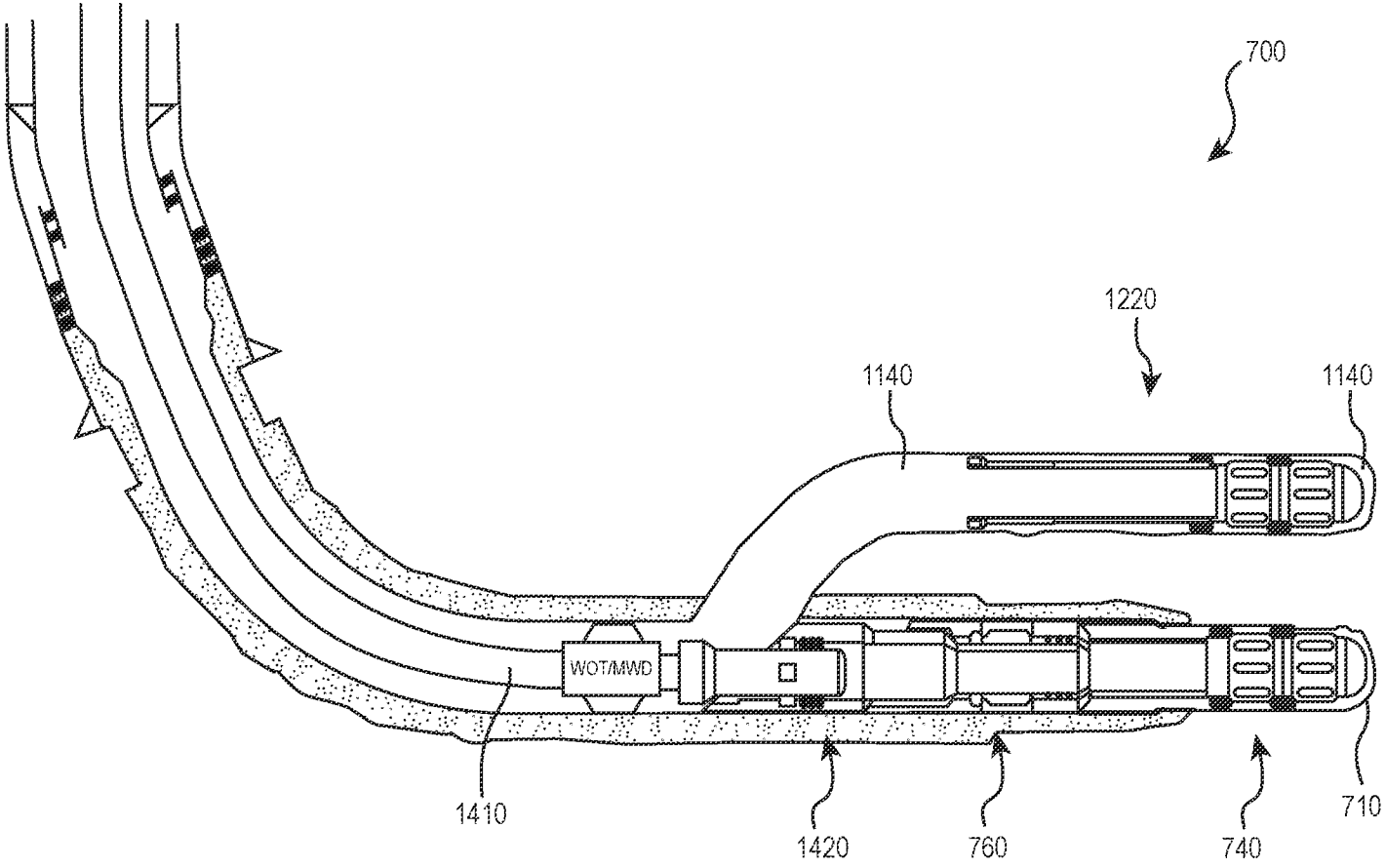

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
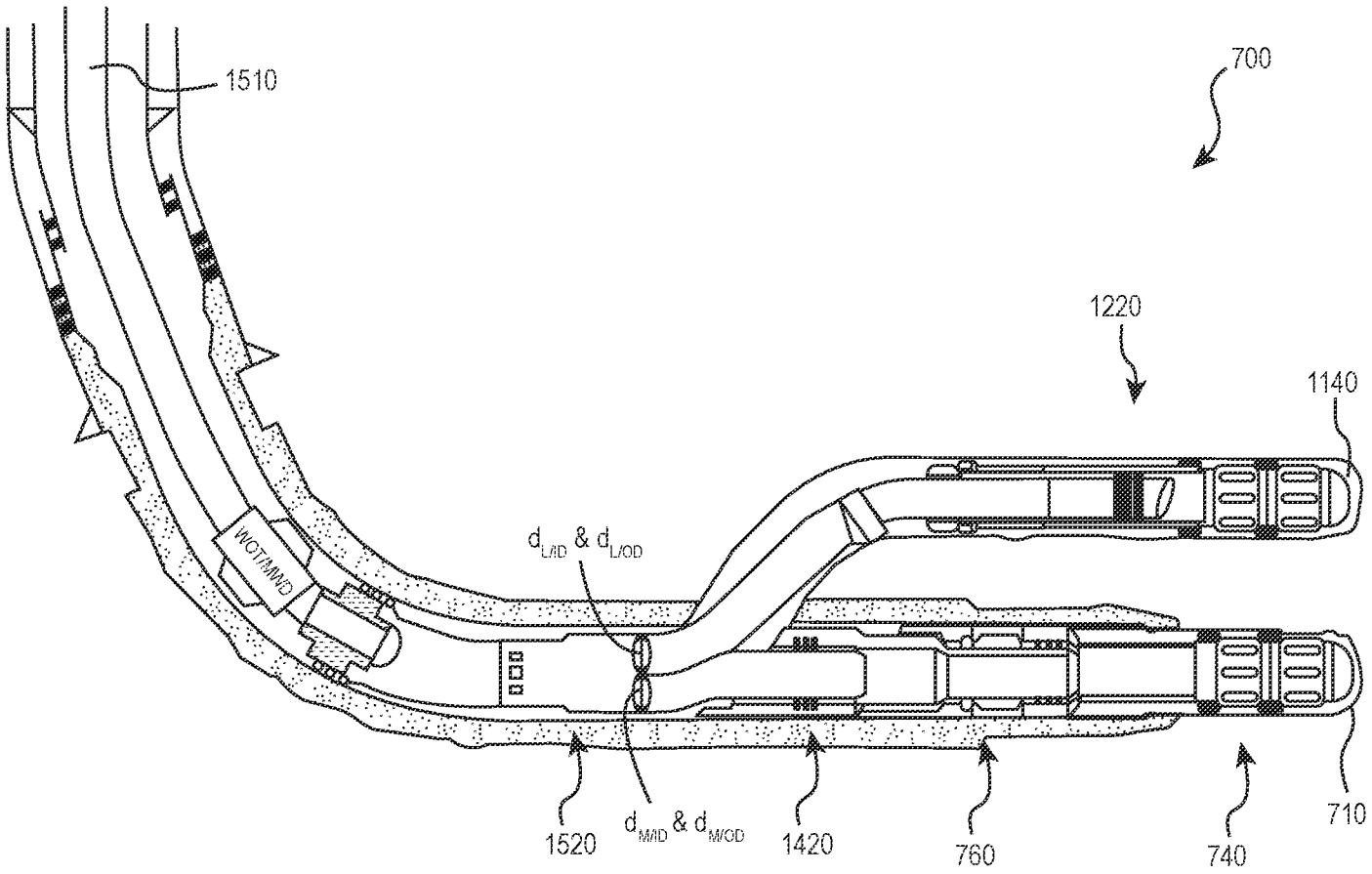

Turning to FIG. 15, illustrated is the well system 700 of FIG. 14 after employing a running tool 1510 to place a multilateral junction 1520 proximate an intersection between the main wellbore 710 and the lateral wellbore 1410. In accordance with one embodiment, the multilateral junction 1520 may include similar features as the multilateral junction 600 discussed above. Accordingly, the multilateral junction 1520 may be installed as a unitary junction, wherein the y-block, mainbore leg and lateral bore leg are all run at the same time. In another embodiments, other types of multilateral junctions 1520 maybe utilized, such as a two-piece junction where a portion of the multilateral junction (e.g., the mainbore leg) is run separately prior to running of the other portion of the junction (e.g., lateral bore leg). In other embodiments, where large-access to the mainbore and/or lateral leg is not required, a multilateral junction 1520 with smaller legs may be used. Accordingly, the multilateral junction 1520 would include a y-block designed, manufactured, and operated according to one or more embodiments of the disclosure, and could be operable to handle at least 8,000 psi burst rate, or in yet another embodiment at least about 10,000 psi burst rate.

In the illustrated embodiment, the multilateral junction 1520 includes a y-block similar to the y-block 200 illustrated with respect to FIGS. 2 through 5B. For example, while not easily illustrated given the scale of FIG. 15, the multilateral junction 1520 could have a y-block with the aforementioned second and third centerlines that are angled relative to one another. Moreover, the main bore leg and lateral bore leg could have the inner diameters ($d_{M/ID}$) and diameters ($d_{L/ID}$), as well as the outer diameters ($d_{M/OD}$) and diameters ($d_{L/OD}$) discussed above. For example, the main bore leg and the lateral bore leg might have an inner diameter ($d_{M/ID}$) and diameter ($d_{L/ID}$) of at least about 80 mm, or in another embodiment of at least about 87 mm, or in yet another embodiment of at least about 90 mm.

Figure 16:
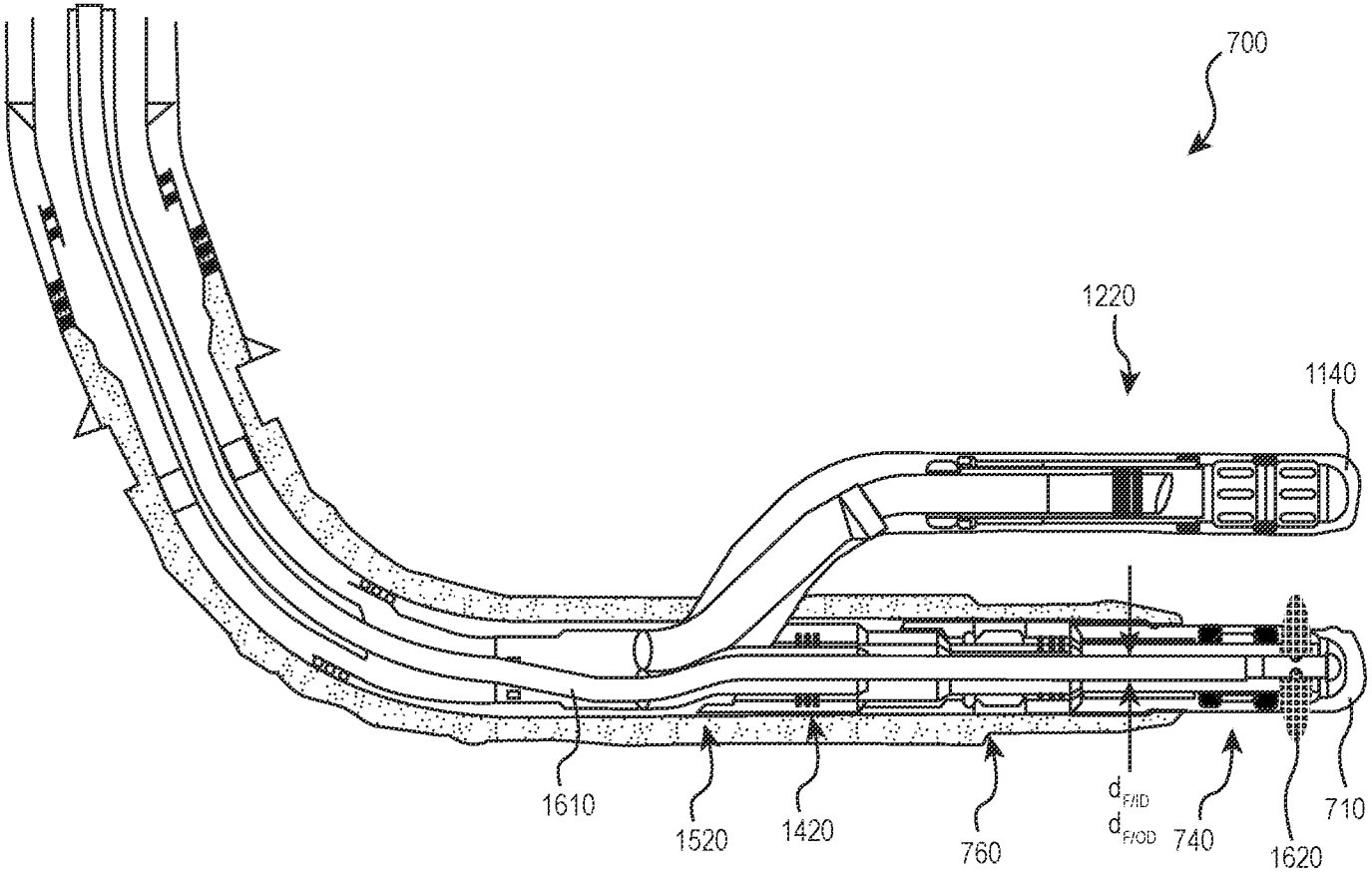

Turning to FIG. 16, illustrated is the well system 700 of FIG. 15 after selectively accessing the main wellbore 710 with a first intervention tool 1610 through the y-block of the multilateral junction 1520. In the illustrated embodiment, the first intervention tool 1610 is a first fracturing string, and more particularly a coiled tubing conveyed fracturing string. The first fracturing string may have any of the outside diameters ($d_{F/OD}$) and inside diameters ($d_{F/ID}$) discussed above and remain within the scope of the disclosure. For example, the first fracturing string could have an outside diameter ($d_{F/OD}$) of at least about 78 mm, or in yet another embodiment of at least about 85.7. Similarly, the first fracturing string could have an inside diameter ($d_{F/ID}$) of at least about 50.8 mm. With the first intervention tool 1610 in place, fractures 1620 in the subterranean formation surrounding the main wellbore completion 740 may be formed. Thereafter, the first intervention tool 1610 may be pulled from the main wellbore completion 740.

Figure 17:
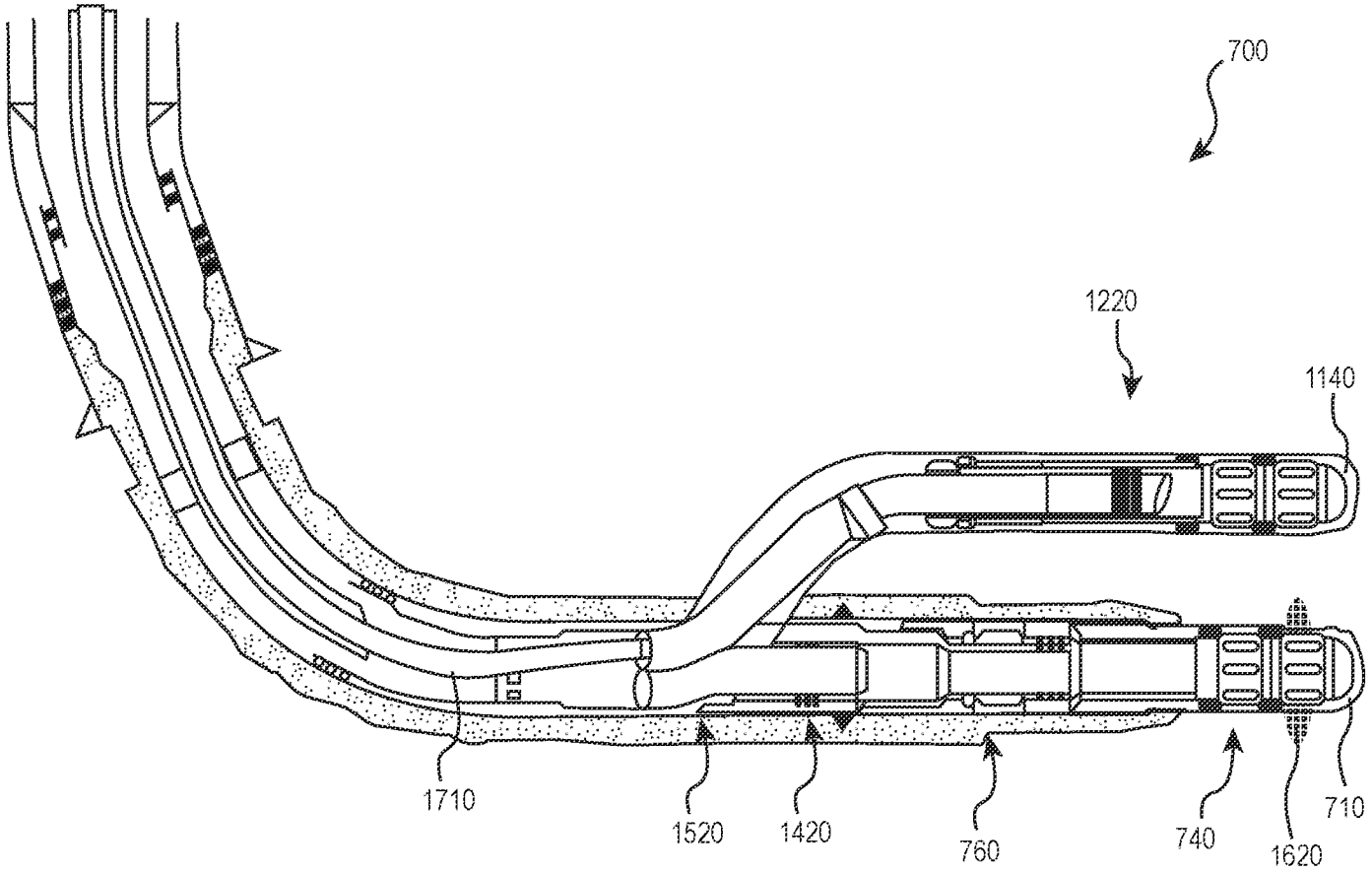

Turning to FIG. 17, illustrated is the well system 700 of FIG. 16 after positioning a second intervention tool 1710 within the multilateral junction 1520 including the y-block. In the illustrated embodiment, the second intervention tool 1710 is a second fracturing string, and more particularly a coiled tubing conveyed fracturing string. The second fracturing string may have any of the outside diameters ($d_{F/OD}$) and inside diameters ($d_{F/ID}$) discussed above and remain within the scope of the disclosure. For example, the second fracturing string could have an outside diameter ($d_{F/OD}$) of at least about 78 mm, or in yet another embodiment of at least about 85.7. Similarly, the second fracturing string could have an inside diameter ($d_{F/ID}$) of at least about 50.8 mm.

Figure 18:
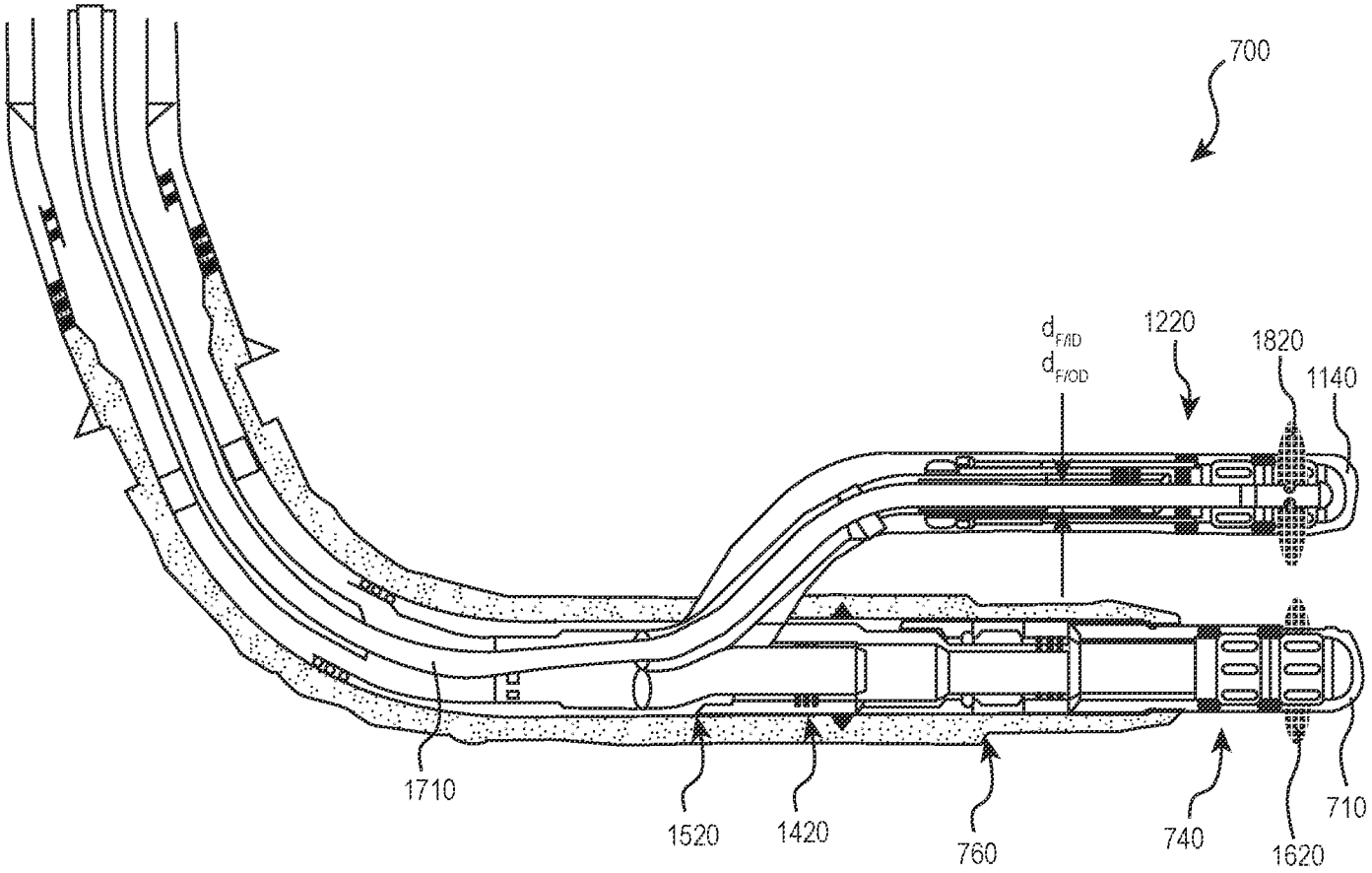

Turning to FIG. 18, illustrated is the well system 700 of FIG. 17 after putting additional weight down on the second intervention tool 1710 and causing the second intervention tool 1710 to enter the lateral wellbore 1140. With the downhole tool 1710 in place, fractures 1820 in the subterranean formation surrounding the lateral wellbore completion 1220 may be formed. In certain embodiments, the first intervention tool 1610 and the second intervention tool 1710 are the same intervention tool, and thus the same fracturing tool in one or more embodiments. Thereafter, the second intervention tool 1710 may be pulled from the lateral wellbore completion 1220 and out of the hole.

The embodiments discussed above reference that the main wellbore 710 is selectively accessed and fractured prior to the lateral wellbore 1140. Nevertheless, other embodiments may exist wherein the lateral wellbore 1140 is selectively accessed and fractured prior to the main wellbore 710. The embodiments discussed above additionally reference that both the main wellbore 710 and the lateral wellbore 1140 are selectively accessed and fractured through the y-block. Other embodiments may exist wherein only one of the main wellbore 710 or the lateral wellbore 1140 is selectively accessed and fractured through the y-block.

Figure 19:
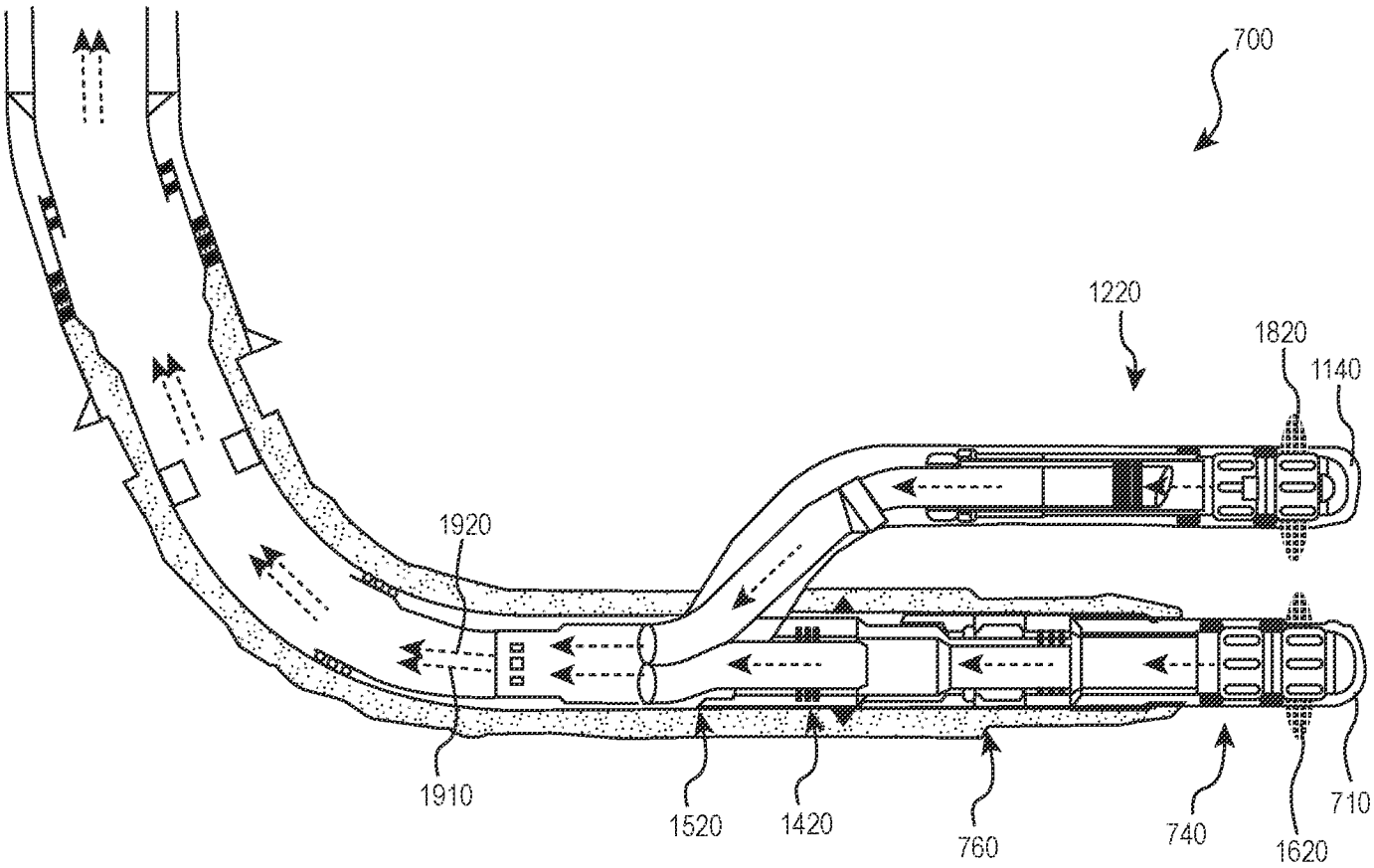

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520, and more specifically through the y-block design, manufactured and operated according to one or more embodiments of the disclosure.

Aspects disclosed herein include:

A. A y-block, the y-block including: 1) a housing having a first end and a second opposing end; 2) a single first bore extending into the housing from the first end, the single first bore defining a first centerline; and 3) second and third separate bores extending into the housing and branching off from the single first bore, the second bore defining a second centerline and the third bore defining a third centerline, wherein the second and third centerlines are angled relative to one another.

B. A multilateral junction, the multilateral junction including: 1) a y-block, the y-block including; a) a housing having a first end and a second opposing end; b) a single first bore extending into the housing from the first end, the single first bore defining a first centerline; and c) second and third separate bores extending into the housing and branching off from the single first bore, the second bore defining a second centerline and the third bore defining a third centerline, wherein the second and third centerlines are angled relative to one another; 2) a mainbore leg coupled to the second bore for extending into the main wellbore; and 3) a lateral bore leg coupled to the third bore for extending into the lateral wellbore.

C. A well system, the well system including: 1) a main wellbore; 2) a lateral wellbore extending from the main wellbore; and 3) a multilateral junction positioned at an intersection of the main wellbore and the lateral wellbore, the multilateral junction including; a) a y-block, the y-block including; i) a housing having a first end and a second opposing end; ii) a single first bore extending into the housing from the first end, the single first bore defining a first centerline; and iii) second and third separate bores extending into the housing and branching off from the single first bore, the second bore defining a second centerline and the third bore defining a third centerline, wherein the second and third centerlines are angled relative to one another; b) a mainbore leg coupled to the second bore and extending into the main wellbore; and c) a lateral bore leg coupled to the third bore and extending into the lateral wellbore.

D. A method for accessing a well system, the method including: 1) placing a multilateral junction proximate an intersection between a main wellbore and a lateral wellbore, the multilateral junction including; a) a y-block, the y-block including; i) a housing having a first end and a second opposing end; ii) a single first bore extending into the housing from the first end, the single first bore defining a first centerline; and iii) second and third separate bores extending into the housing and branching off from the single first bore, the second bore defining a second centerline and the third bore defining a third centerline; b) a mainbore leg coupled to the second bore and extending into the main wellbore; and c) a lateral bore leg coupled to the third bore and extending into the lateral wellbore; and 2) selectively accessing at least one of the main wellbore or the lateral wellbore with a fracturing string through the y-block.

Aspects A, B, C and D may have one or more of the following additional elements in combination: Element 1: wherein the second centerline is angled relative to the first centerline. Element 2: wherein the third centerline is angled relative to the first centerline. Element 3: wherein the second centerline has a greater angle (θ) between itself and the first centerline than an angle (α) between the third centerline and the first centerline. Element 4: wherein the second bore is a main leg bore and the third bore is a lateral leg bore. Element 5: wherein the second bore has a diameter ($d_2$) and the third bore has a diameter ($d_3$), and further wherein the diameter ($d_2$) is the same as the diameter ($d_3$). Element 6: wherein the second bore has a first portion having the diameter ($d_2$) and a second portion having a greater diameter ($d_{2'}$). Element 7: wherein the second portion is located between the first portion and the single first bore. Element 8: wherein a length ($L_2$) of the second portion is at least two times a length ($L_1$) of the first portion. Element 9: wherein the second and third bores overlap one another proximate the single first bore. Element 10: wherein a shared interior wall of the second and third bores comes to a sharp point at a location wherein the second and third bores overlap one another. Element 11: wherein a shared interior wall of the second and third bores comes to a blunt stress relief point at a location wherein the second and third bores overlap one another. Element 12: wherein the third bore includes a box joint at the second opposing end. Element 13: wherein the second bore includes a pin joint at the second opposing end. Element 14: wherein the mainbore leg and the lateral bore leg are threadingly engaged with the y-block. Element 15: wherein the second bore and the third bore each include only a single straight centerline. Element 16: wherein the second centerline is angled relative to the first centerline. Element 17: wherein the third centerline is angled relative to the first centerline. Element 18: wherein the second centerline has a greater angle (θ) between itself and the first centerline than an angle (α) between the third centerline and the first centerline. Element 19: wherein the second bore is a main leg bore and the third bore is a lateral leg bore. Element 20: wherein the second bore has a diameter ($d_2$) and the third bore has a diameter ($d_3$), and further wherein the diameter ($d_2$) is the same as the diameter ($d_3$). Element 22: wherein the second bore has a first portion having the diameter ($d_2$) and a second portion having a greater diameter ($d_{2'}$). Element 23: wherein the second portion is located between the first portion and the single first bore. Element 24: wherein a length ($L_2$) of the second portion is at least two times a length ($L_1$) of the first portion. Element 25: wherein the second and third bores overlap one another proximate the single first bore. Element 26: wherein a shared interior wall of the second and third bores comes to a sharp point at a location wherein the second and third bores overlap one another. Element 27: wherein a shared interior wall of the second and third bores comes to a blunt stress relief point at a location wherein the second and third bores overlap one another. Element 28: wherein the third bore includes a box joint at the second opposing end. Element 29: wherein the second bore includes a pin joint at the second opposing end. Element 30: wherein the mainbore leg and the lateral bore leg are threadingly engaged with the y-block. Element 31: wherein the second bore and the third bore each include only a single straight centerline. Element 32: wherein the second centerline is angled relative to the first centerline and the third centerline is angled relative to the first centerline. Element 33: wherein the second centerline has a greater angle (θ) between itself and the first centerline than an angle (α) between the third centerline and the first centerline. Element 34: wherein the second bore has a first portion having the diameter ($d_2$) and a second portion having a greater diameter ($d_{2'}$). Element 35: wherein the second portion is located between the first portion and the single first bore. Element 36: wherein the second and third bores overlap one another proximate the single first bore. Element 37: wherein a shared interior wall of the second and third bores comes to a sharp point at a location wherein the second and third bores overlap one another. Element 38: wherein a shared interior wall of the second and third bores comes to a blunt stress relief point at a location wherein the second and third bores overlap one another. Element 39: wherein further including fracturing the at least one of the main wellbore or the lateral wellbore with the fracturing string extending through the y-block. Element 40: wherein selectively accessing at least one of the main wellbore or the lateral wellbore includes selectively accessing the main wellbore with a first fracturing string through the y-block. Element 41: further including fracturing the main wellbore with the first fracturing string extending through the y-block. Element 42: further including selectively accessing the lateral wellbore with a second fracturing string through the y-block. Element 43: further including fracturing the lateral wellbore with the second fracturing string extending through the y-block. Element 44: wherein selectively accessing the main wellbore and fracturing the main wellbore occurs prior to selectively accessing the lateral wellbore and fracturing the lateral wellbore. Element 45: wherein selectively accessing the main wellbore and fracturing the main wellbore occurs after selectively accessing the lateral wellbore and fracturing the lateral wellbore. Element 46: wherein further including producing fluids from fractures in the main wellbore and fractures in the lateral wellbore through the y-block. Element 47: wherein the main bore leg and lateral bore leg have an inner diameter ($d_{M/ID}$) and diameter ($d_{L/ID}$), respectively, of at least about 80 mm. Element 48: wherein the main bore leg and lateral bore leg have an inner diameter ($d_{M/ID}$) and diameter ($d_{L/ID}$), respectively, of at least about 87 mm. Element 49: wherein the main bore leg and lateral bore leg have an inner diameter ($d_{M/ID}$) and diameter ($d_{L/ID}$), respectively, of at least about 90 mm. Element 50: wherein the fracturing string has an outside diameter ($d_{F/OD}$) of at least about 78 mm. Element 51: wherein the fracturing string has an outside diameter ($d_{F/OD}$) of at least about 85.7 mm. Element 52: wherein the fracturing string has an inside diameter ($d_{F/ID}$) of at least about 50.8 mm. Element 53: wherein the multilateral junction is operable to handle at least 8,000 psi burst rate. Element 54: wherein the multilateral junction is operable to handle at least 10,000 psi burst rate. Element 55: wherein the second and third centerlines are angled relative to one another. Element 56: wherein the second and third bores overlap one another proximate the single first bore. Element 57: wherein a shared interior wall of the second and third bores comes to a sharp point at a location wherein the second and third bores overlap one another. Element 58: wherein a shared interior wall of the second and third bores comes to a blunt stress relief point at a location wherein the second and third bores overlap one another.

Those skilled in the art to which this application relates will appreciate that other and further additions, deletions, substitutions and modifications may be made to the described embodiments.

What is claimed is:

1. A y-block, comprising:

a housing comprising a monolithic block of material, the housing having a first end and a second opposing end defining a length (L);

a single first bore extending into the monolithic block of material from the first end, the single first bore defining a first centerline; and second and third separate bores extending into the monolithic block of material and branching off from the single first bore, the second bore defining a second centerline and the third bore defining a third centerline, wherein the second and third centerlines are angled relative to one another, wherein the second and third bores include a shared interior wall along at least a portion of the length (L), the shared interior wall extending to a downhole end of at least one of the second or third separate bores, wherein the second bore includes a pin joint at the second opposing end and the third bore includes a box joint at the second opposing end.

2. The y-block as recited in claim 1, wherein the second centerline is angled relative to the first centerline.

3. The y-block as recited in claim 2, wherein the third centerline is angled relative to the first centerline.

4. The y-block as recited in claim 3, wherein the second centerline has a greater angle ($\theta$) between itself and the first centerline than an angle ($\alpha$) between the third centerline and the first centerline.

5. The y-block as recited in claim 4, wherein the second bore is a main leg bore and the third bore is a lateral leg bore.

6. The y-block as recited in claim 1, wherein the second bore has a diameter ($d_2$) and the third bore has a diameter ($d_3$), and further wherein the diameter ($d_2$) is the same as the diameter ($d_3$).

7. The y-block as recited in claim 6, wherein the second bore has a first portion having the diameter ($d_2$) and a second portion having a greater diameter ($d_{2'}$).

8. The y-block as recited in claim 7, wherein the second portion is located between the first portion and the single first bore.

9. The y-block as recited in claim 8, wherein a length ($L_2$) of the second portion is at least two times a length ($L_1$) of the first portion.

10. The y-block as recited in claim 1, wherein the second and third bores overlap one another proximate the single first bore.

11. The y-block as recited in claim 10, wherein the shared interior wall of the second and third bores comes to a sharp point at a location wherein the second and third bores overlap one another.

12. The y-block as recited in claim 10, wherein the shared interior wall of the second and third bores comes to a blunt stress relief point at a location wherein the second and third bores overlap one another.

13. A multilateral junction, comprising:

a y-block, the y-block including;

a housing comprising a monolithic block of material, the housing having a first end and a second opposing end defining a length (L);

a single first bore extending into the monolithic block of material from the first end, the single first bore defining a first centerline; and second and third separate bores extending into the monolithic block of material and branching off from the single first bore, the second bore defining a second centerline and the third bore defining a third centerline, wherein the second and third centerlines are angled relative to one another, wherein the second and third bores include a shared interior wall along at least a portion of the length (L), the shared interior wall extending to a downhole end of at least one of the second or third separate bores, wherein the second bore includes a pin joint at the second opposing end and the third bore includes a box joint at the second opposing end;

a mainbore leg coupled to one of the second bore or the third bore for extending into a main wellbore; and a lateral bore leg coupled to an other of the third bore or the second bore for extending into a lateral wellbore.

14. The multilateral junction as recited in claim 13, wherein the mainbore leg and the lateral bore leg are threadingly engaged with the y-block.

15. The multilateral junction as recited in claim 13, wherein the second bore and the third bore each include only a single straight centerline.

16. The multilateral junction as recited in claim 13, wherein the second centerline is angled relative to the first centerline.

17. The multilateral junction as recited in claim 16, wherein the third centerline is angled relative to the first centerline.

18. The multilateral junction as recited in claim 17, wherein the second centerline has a greater angle ($\theta$) between itself and the first centerline than an angle ($\alpha$) between the third centerline and the first centerline.

19. The multilateral junction as recited in claim 18, wherein the second bore is a main leg bore and the third bore is a lateral leg bore.

20. The multilateral junction as recited in claim 13, wherein the second bore has a diameter ($d_2$) and the third bore has a diameter ($d_3$), and further wherein the diameter ($d_2$) is the same as the diameter ($d_3$).

21. The multilateral junction as recited in claim 20, wherein the second bore has a first portion having the diameter ($d_2$) and a second portion having a greater diameter ($d_{2'}$).

22. The multilateral junction as recited in claim 21, wherein the second portion is located between the first portion and the single first bore.

23. The multilateral junction as recited in claim 22, wherein a length ($L_2$) of the second portion is at least two times a length ($L_1$) of the first portion.

24. The multilateral junction as recited in claim 13, wherein the second and third bores overlap one another proximate the single first bore.

25. The multilateral junction as recited in claim 24, wherein the shared interior wall of the second and third bores comes to a sharp point at a location wherein the second and third bores overlap one another.

26. The multilateral junction as recited in claim 24, wherein the shared interior wall of the second and third bores comes to a blunt stress relief point at a location wherein the second and third bores overlap one another.

27. A well system, comprising:

a main wellbore;

a tubing string located in the main wellbore a lateral wellbore extending from the main wellbore; and a multilateral junction positioned at an intersection of the main wellbore and the lateral wellbore, the multilateral junction including;

a y-block located in the tubing string, the y-block including;

a housing comprising a monolithic block of material, the housing having a first end and a second opposing end defining a length (L);

a single first bore extending into the monolithic block of material from the first end, the single first bore defining a first centerline; and second and third separate bores extending into the monolithic block of material and branching off from the single first bore, the second bore defining a second centerline and the third bore defining a third centerline, wherein the second and third centerlines are angled relative to one another, wherein the second and third bores include a shared interior wall along at least a portion of the length (L), the shared interior wall extending to a downhole end of at least one of the second or third separate bores, wherein the second bore includes a pin joint at the second opposing end and the third bore includes a box joint at the second opposing end;

a mainbore leg coupled to one of the second bore or the third bore and extending into the main wellbore; and a lateral bore leg coupled to an other of the third bore or the second bore and extending into the lateral wellbore.

28. The well system as recited in claim 27, wherein the mainbore leg and the lateral bore leg are threadingly engaged with the y-block.

29. The well system as recited in claim 27, wherein the second bore and the third bore each include only a single straight centerline.

30. The well system as recited in claim 27, wherein the second centerline is angled relative to the first centerline and the third centerline is angled relative to the first centerline.

31. The well system as recited in claim 30, wherein the second centerline has a greater angle ($\theta$) between itself and the first centerline than an angle ($\alpha$) between the third centerline and the first centerline.

32. The well system as recited in claim 27, wherein the second bore has a first portion having a diameter ($d_2$) and a second portion having a greater diameter ($d_{2'}$).

33. The well system as recited in claim 32, wherein the second portion is located between the first portion and the single first bore.

34. The well system as recited in claim 27, wherein the second and third bores overlap one another proximate the single first bore.

35. The well system as recited in claim 34, wherein the shared interior wall of the second and third bores comes to a sharp point at a location wherein the second and third bores overlap one another.

36. The well system as recited in claim 34, wherein the shared interior wall of the second and third bores comes to a blunt stress relief point at a location wherein the second and third bores overlap one another.

* * * * *